US009631849B2

(12) United States Patent
Morimoto et al.

(10) Patent No.: US 9,631,849 B2
(45) Date of Patent: Apr. 25, 2017

(54) HEAT MEDIUM RELAY UNIT AND AIR-CONDITIONING APPARATUS EQUIPPED WITH SAME

(75) Inventors: Hiroyuki Morimoto, Tokyo (JP); Koji Yamashita, Tokyo (JP); Yuji Motomura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 693 days.

(21) Appl. No.: 13/876,708

(22) PCT Filed: Oct. 12, 2010

(86) PCT No.: PCT/JP2010/006061

§ 371 (c)(1),
(2), (4) Date: Mar. 28, 2013

(87) PCT Pub. No.: WO2012/049704

PCT Pub. Date: Apr. 19, 2012

(65) Prior Publication Data

US 2013/0199231 A1 Aug. 8, 2013

(51) Int. Cl.
*F25B 30/02* (2006.01)
*F24F 3/06* (2006.01)
(Continued)

(52) U.S. Cl.
CPC ..... *F25B 30/02* (2013.01); *F24F 3/065* (2013.01); *F24F 13/30* (2013.01); *F25B 13/00* (2013.01);
(Continued)

(58) Field of Classification Search
CPC ..... F25B 2313/023; F25B 2313/0233; F25B 2313/006; F25B 2313/0272; F25B 30/02; F24F 3/065
(Continued)

(56) References Cited

U.S. PATENT DOCUMENTS 7,106,590 B2 * 9/2006 Chu ..... H05K 7/2079 165/104.33
7,602,609 B2 * 10/2009 Spearing ..... H05K 7/2079 165/104.33
(Continued)

FOREIGN PATENT DOCUMENTS

JP 03017475 * 1/1991
JP 05-280818 A 10/1993
(Continued)

OTHER PUBLICATIONS

English translation JPH0741361.*
(Continued)

*Primary Examiner* — Jianying Atkisson
*Assistant Examiner* — Joel Attey
(74) *Attorney, Agent, or Firm* — Posz Law Group, PLC

(57) ABSTRACT

Obtained is a heat medium relay unit capable of having improved serviceability and an air-conditioning apparatus equipped with the heat medium relay unit.
Heat medium flow control devices are each disposed below a corresponding one of the first heat medium flow switching devices. The heat medium flow control devices are similarly disposed in a zigzag manner along with the zigzag arrangement of the first heat medium flow switching devices.

11 Claims, 10 Drawing Sheets

(51) Int. Cl.

| | |
|---|---|
| ***F25B 13/00*** | (2006.01) |
| ***F25B 25/00*** | (2006.01) |
| ***F24F 13/30*** | (2006.01) |

(52) U.S. Cl.
CPC ..... *F25B 25/005* (2013.01); *F25B 2313/006* (2013.01); *F25B 2313/023* (2013.01); *F25B 2313/0231* (2013.01); *F25B 2313/0233* (2013.01); *F25B 2313/0272* (2013.01); *F25B 2313/02742* (2013.01)

(58) Field of Classification Search
USPC ..... 62/238.7
See application file for complete search history.

(56) References Cited

U.S. PATENT DOCUMENTS

| | | | | |
|---|---|---|---|---|
| 8,297,069 | B2 * | 10/2012 | Novotny | H05K 7/2079 62/259.2 |
| 2008/0198549 | A1 * | 8/2008 | Rasmussen | H05K 7/2079 361/696 |
| 2009/0126909 | A1 * | 5/2009 | Ellsworth, Jr. | H05K 7/2079 165/104.33 |
| 2009/0133866 | A1 * | 5/2009 | Campbell | G06F 1/20 165/288 |

FOREIGN PATENT DOCUMENTS

| | | | |
|---|---|---|---|
| JP | H0741361 | * | 7/1995 |
| JP | 2001-241696 | A | 9/2001 |
| JP | 2001-289465 | A | 10/2001 |
| JP | 2003-343936 | A | 12/2003 |
| JP | 2004-340568 | A | 12/2004 |
| JP | 2005-140444 | A | 6/2005 |
| JP | 2006-017374 | A | 1/2006 |
| JP | 2006-300381 | A | 2/2006 |

OTHER PUBLICATIONS

English translation JP 03017475.*
Refrigeration Control Valve Maintenance. Air Conditioning, Heating & Refrigeration News [serial online]. 2001:Available from: General OneFile, Ipswich, MA. Accessed May 12, 2016.*
International Search Report of the International Searching Authority mailed Dec. 28, 2010 for the corresponding international application No. PCT/JP2010/006061 (with English translation).
Office Action dated Feb. 13, 2015 issued in corresponding CN patent application No. 201080069566.X (and English translation).

* cited by examiner 1
11
10
12
13a
13b
13c
13d
4a
4b
19
100
4
A
3
B
2
2a
2b
2c
2d
5
15a
15b
16a
16b
17a
17b
18a
18b
21a
21b
22a
22b
22c
22d
23a
23b
23c
23d
25a
25b
25c
25d
26a
26b
26c
26d
31a
31b
34a
34b
34c
34d
35a
35b
35c
35d
36
40a
40b
40c
40d
41a
41b
41c
41d FIG. 7
(a)
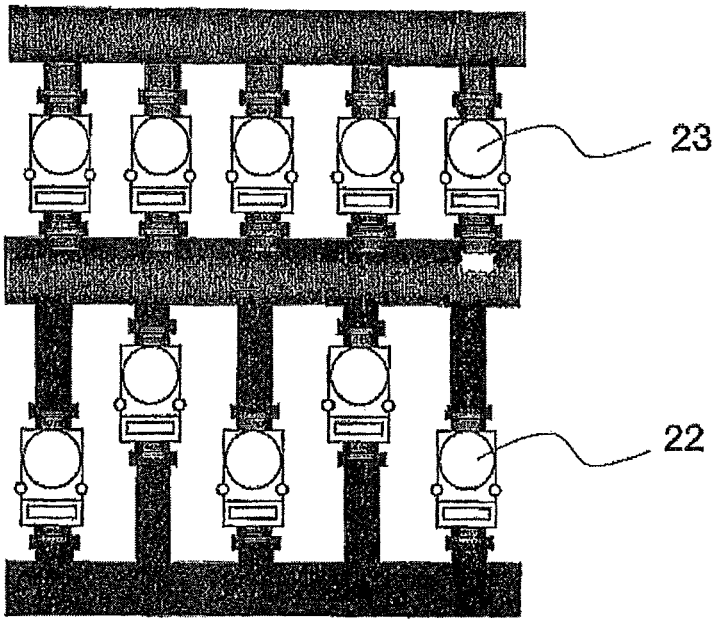
(b)
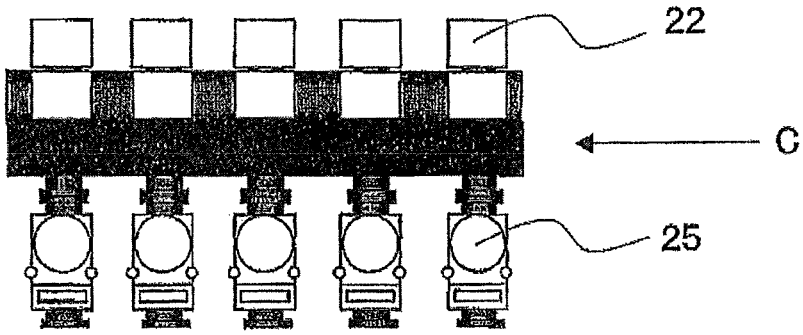

HEAT MEDIUM RELAY UNIT AND AIR-CONDITIONING APPARATUS EQUIPPED WITH SAME

CROSS REFERENCE TO RELATED APPLICATION

This application is a U.S. national stage application of PCT/JP2010/006061 filed on Oct. 12, 2010.

TECHNICAL FIELD

The present invention relates to a heat medium relay unit that is applied to, for example, a multi-air-conditioning apparatus for a building and relates to an air-conditioning apparatus that is equipped with the heat medium relay unit.

BACKGROUND

Conventionally, an air-conditioning apparatus, such as a multi-air-conditioning apparatus for a building, is configured such that cooling operation or heating operation is carried out by circulating a refrigerant between an outdoor unit that is a heat source device disposed outdoors and indoor units disposed indoors. Specifically, heating or cooling of a conditioned space is carried out with air that has been heated by the refrigerant rejecting its heat into the air or with air that has been cooled by the refrigerant removing its heat. Regarding the refrigerant used for such an air-conditioning apparatus, a hydrofluorocarbon (HFC) based refrigerant, for example, is typically used. An air-conditioning apparatus using a natural refrigerant, such as carbon dioxide ($CO_2$), has also been proposed.

There is also an air-conditioning apparatus having a different configuration represented by a chiller system. Further, in such an air-conditioning apparatus, cooling or heating is carried out such that cooling energy or heating energy is generated in a heat source device disposed outdoors; a heat medium such as water or brine is heated or cooled in a heat exchanger disposed in an outdoor unit; and the heat medium is conveyed to indoor units, such as a fan coil unit or a panel heater, disposed in the conditioned space (see Patent Literature 1, for example).

Moreover, there has been proposed an air-conditioning apparatus called a heat recovery chiller in which a heat source unit is connected to each indoor unit with four water pipes arranged therebetween, supplies cooled or heated water or the like simultaneously, and allows cooling or heating to be freely selected in the indoor units (see Patent Literature 2, for example).

In addition, there is an air-conditioning apparatus configured such that a heat exchanger for a primary refrigerant and a secondary refrigerant is disposed near each indoor unit and the secondary refrigerant is conveyed to the indoor units (see Patent Literature 3, for example).

Furthermore, there is an air-conditioning apparatus in which an outdoor unit is connected to each branch unit including a heat exchanger with two pipes and in which a secondary refrigerant is conveyed to the corresponding indoor unit (see Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application Publication No. 5-280818 (pp. 4 to 5, FIG. 1, for example)

Patent Literature 3: Japanese Unexamined Patent Application Publication No. 2001-289465 (pp. 5 to 8, FIGS. 1 and 2, for example)

Patent Literature 4: Japanese Unexamined Patent Application Publication No. 2003-343936 (p. 5, FIG. 1)

Technical Problem

In conventional air-conditioning apparatuses, such as a multi-air-conditioning apparatus for a building, since the refrigerant is circulated to an indoor unit, there is a possibility of refrigerant leakage into, for example, an indoor space. On the other hand, in the air-conditioning apparatuses disclosed in Patent Literature 1 and Patent Literature 2, the refrigerant does not pass through the indoor unit. However, since the heat medium needs to be heated or cooled in a heat source unit disposed outside a structure, and needs to be conveyed to the indoor unit side, the circulation path of the heat medium becomes long. In this case, when conveying heat for a predetermined heating or cooling work with the heat medium, energy consumption due to conveyance power and the like becomes disadvantageously higher than that of the refrigerant. This indicates that energy saving can be achieved in an air-conditioning apparatus if the circulation of the heat medium can be controlled appropriately.

Further, in the air-conditioning apparatus disclosed in Patent Literature 2, the outdoor side and the indoor space need to be connected with four pipes in order to allow cooling or heating to be selected in each indoor unit. Disadvantageously, there is little ease of construction.

Furthermore, in the air-conditioning apparatus disclosed in Patent Literature 3, secondary medium circulating means such as a pump needs to be provided to each indoor unit. Disadvantageously, this system is not only costly but also creates a large amount of noise, and is not practical. In addition to this, since the heat exchanger is disposed near each indoor unit, there is a problem in that risk of refrigerant leakage into a place near the indoor space cannot be eliminated.

Additionally, in the air-conditioning apparatus disclosed in Patent Literature 4, a primary refrigerant (a heat source side refrigerant) that has exchanged heat flows into the same passage as the primary refrigerant before heat exchange. Accordingly, when a plurality of indoor units are connected, there arises a problem in that it is difficult for each indoor unit to exhibit its maximum capacity; hence, the configuration is one that wastes energy. Further, each branch unit is connected to an extension pipe with a total of four pipes, two for cooling and two for heating. This configuration is consequently similar to that of a system in which the outdoor unit is connected to each branching unit with four pipes. Accordingly, ease of construction is poor in such a system.

Furthermore, in conventional air-conditioning apparatuses, a heat medium flow control device (an on-off valve or a flow rate valve) disposed in the secondary side circuit (the circuit on the use side heat exchanger connection side) is operated frequently. As such, the failure rate of the heat medium flow control device is high and thus, disadvantageously, it is a prerequisite that replacement of the heat medium flow control device will be required.

SUMMARY

The invention is directed to overcoming the above problems and a first object thereof is to obtain a heat medium relay unit that is capable of improving serviceability and an air-conditioning apparatus equipped with the same. Furthermore, a second object is to obtain a heat medium relay unit that is capable of improving safety by not circulating a refrigerant to or near an indoor unit and to obtain an air-conditioning apparatus equipped with the same.

A heat medium relay unit according to the invention includes a heat exchanger related to heat medium that exchanges heat between a refrigerant in a refrigerant circuit in which the refrigerant is circulated by being discharged from a compressor provided in an outdoor unit and a heat medium, which is different from the refrigerant, in a heat medium circuit in which the heat medium is circulated and sent to a plurality of indoor units with a pump;

a plurality of heat medium flow control devices that each controls a flow rate of the heat medium sent to a use side heat exchanger of each indoor unit; a main body that houses the heat exchanger related to heat medium and the heat medium flow control devices; and heat medium flow switching devices disposed so as to correspond to the indoor units, the heat medium flow switching devices communicating an inlet side passage or an outlet side passage of the heat medium of each use side heat exchanger with the heat exchanger related to heat medium. The heat medium flow control devices are arranged somewhat toward the service side of the main body, the heat medium flow switching devices are disposed in heat medium pipes that are arranged in a direction substantially orthogonal to the service side and that are arranged parallel to each other, and are arranged so as to be offset with respect to a neighboring heat medium flow switching device relative to a same line that is orthogonal to the longitudinal direction of the heat medium pipes. The heat medium flow control devices are connected such that one of pipe ports of each of the heat medium flow control devices is connected to a pipe port on a top side of the corresponding heat medium flow switching device or such that the one of the pipe ports of each of the heat medium flow control devices is connected to a pipe port on a bottom side of the corresponding heat medium flow switching device, a drive motor of each of the heat medium flow control devices is installed on the service side, another one of the pipe ports of each heat medium flow control device is connected to a heat medium pipe that is positioned on an side opposite to the service side and that is oriented towards the corresponding indoor unit in the direction that is substantially orthogonal to the service side, and the outdoor unit and the indoor units are configured as separate housings.

According to the invention, heat medium flow control devices that are subject to maintenance are disposed on the service side of the heat medium relay unit; hence, serviceability can be improved. Further, a heat medium, such as water, brine, or the like, is circulated in the indoor units such that a refrigerant is not allowed to circulate therein; hence, refrigerant does not leak into the indoor space or the like and safety can be improved.

BRIEF DESCRIPTION OF DRAWINGS

FIG. 7 includes drawings showing a structure and arrangement of the first heat medium flow switching devices 22, the second heat medium flow switching devices 23, and the heat medium flow control devices 25 of the heat medium relay unit 3 of the air-conditioning apparatus 100 according to Embodiment 1 of the invention.

DETAILED DESCRIPTION

Embodiment 1

(Configuration of Air-Conditioning Apparatus)

Figure 1:
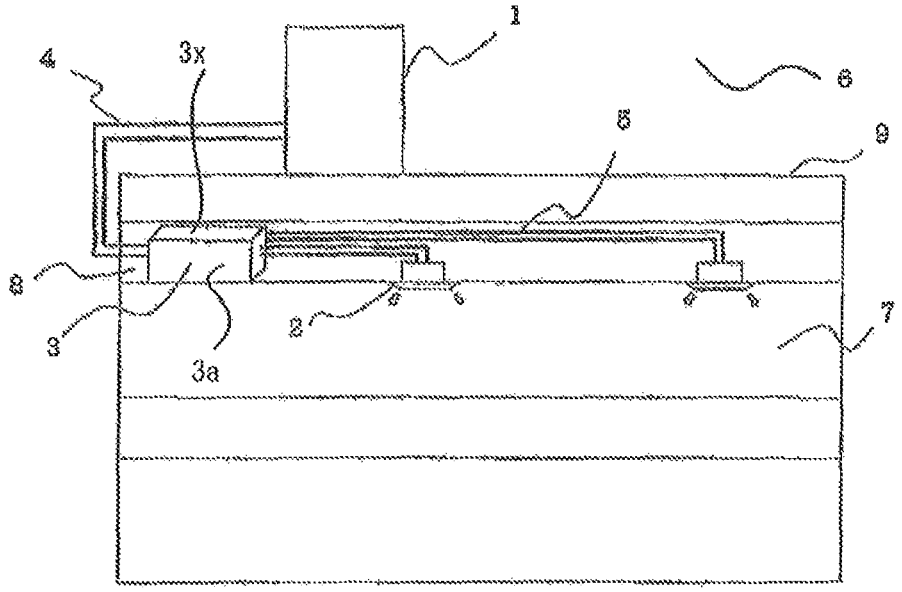
FIG. 1 is a schematic diagram illustrating an exemplary installation of an air-conditioning apparatus according to Embodiment 1 of the invention.

FIG. 1 is a schematic diagram illustrating an exemplary installation of an air-conditioning apparatus according to Embodiment 1 of the invention.

As shown in FIG. 1, the air-conditioning apparatus according to Embodiment 1 includes a single outdoor unit 1 functioning as a heat source unit, a plurality of indoor units 2, and a heat medium relay unit 3 disposed between the outdoor unit 1 and the indoor units 2. The outdoor unit 1 and the heat medium relay unit 3 are connected with refrigerant pipes 4 through which a refrigerant on the heat source side flows. The heat medium relay unit 3 and each indoor unit 2 are connected with pipes 5 through which a heat medium flows. Cooling energy or heating energy generated in the outdoor unit 1 is transferred to the indoor units 2 through the heat medium relay unit 3.

The outdoor unit 1 is typically disposed in an outdoor space 6 that is a space (e.g., a roof) outside a structure 9, such as a building, and is configured to supply cooling energy or heating energy through the heat medium relay unit 3 to the indoor units 2.

Each indoor unit 2 is disposed at a position that allows cooling air or heating air to be supplied to an indoor space 7, which is a conditioned space (e.g., a living room) inside the structure 9, and supplies cooling air or heating air to the indoor space 7.

The heat medium relay unit 3 is configured with a housing 3*x* separate from the outdoor unit 1 and the indoor units 2 such that the heat medium relay unit 3 can be disposed at a position different from those of the outdoor space 6 and the indoor space 7, and is connected to the outdoor unit 1 and the indoor units 2 through the refrigerant pipes 4 and the heat medium pipes 5, respectively, to transfer cooling energy or heating energy, supplied from the outdoor unit 1 to the indoor units 2. Specifically, the heat medium relay unit 3 carries out heat exchange between a heat source side refrigerant on the outdoor unit 1 side and a heat medium (water or brine, for example) on the indoor unit 2 side that is different from this heat source side refrigerant. Referring to FIG. 1, an exemplary state is illustrated in which the heat medium relay unit 3 is disposed in a space 8, such as a space above a ceiling, which is a space in the structure 9 but different from the indoor space 7. Further, the heat medium relay unit 3 is provided close to the indoor units 2 that are disposed in the indoor space 7. Accordingly, the pipes of a circuit (a heat medium circuit B described later) in which the heat medium circulates can be shortened. As a result, it is possible to reduce the conveyance power of the heat medium in the heat medium circuit B and achieve energy saving.

The refrigerant pipes 4 are formed of two pipes and connect the outdoor unit 1 and the heat medium relay unit 3. Further, the heat medium pipes 5 connect the heat medium relay unit 3 and each indoor unit 2, in which each indoor unit 2 is connected with two heat medium pipes 5. As described above, in the air-conditioning apparatus according to Embodiment 1, each of the units (the outdoor unit 1, the indoor units 2, and the heat medium relay unit 3) is connected using two pipes (the refrigerant pipes 4 or the pipes 5), and, thus, construction is facilitated.

Note that although, in FIG. 1, a case is illustrated in which the outdoor unit 1 is disposed in the outdoor space 6, the arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the outdoor unit 1 of a water-cooled type.

In addition, although FIG. 1 illustrates a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

Further, as shown in FIG. 1, the heat medium relay unit 3 is described as being disposed in the space 8; however, not limited to this disposition, the heat medium relay unit 3 may be disposed in a common space or the like where there is an elevator or the like, for example.

Furthermore, as described above, the heat medium relay unit 3 is described as being disposed so as to be near the indoor units 2; however, not limited to this disposition, the heat medium relay unit 3 may be disposed near the outdoor unit 1. However, in this case, it should be noted that when the distance from the heat medium relay unit 3 to the indoor unit 2 is excessively long, because power for conveying the heat medium is significantly large, the advantageous effect of energy saving is reduced.

Additionally, the numbers of connected outdoor unit 1, indoor units 2, and heat medium relay unit 3 are not limited to those illustrated in FIG. 1. The numbers thereof may be determined in accordance with the structure 9 where the air-conditioning apparatus according to Embodiment 1 is installed.

In addition, the dimensional relationships of each of the components are not limited to those illustrated in the subsequent figures including FIG. 1 and may differ from the actual ones.

Figure 2:
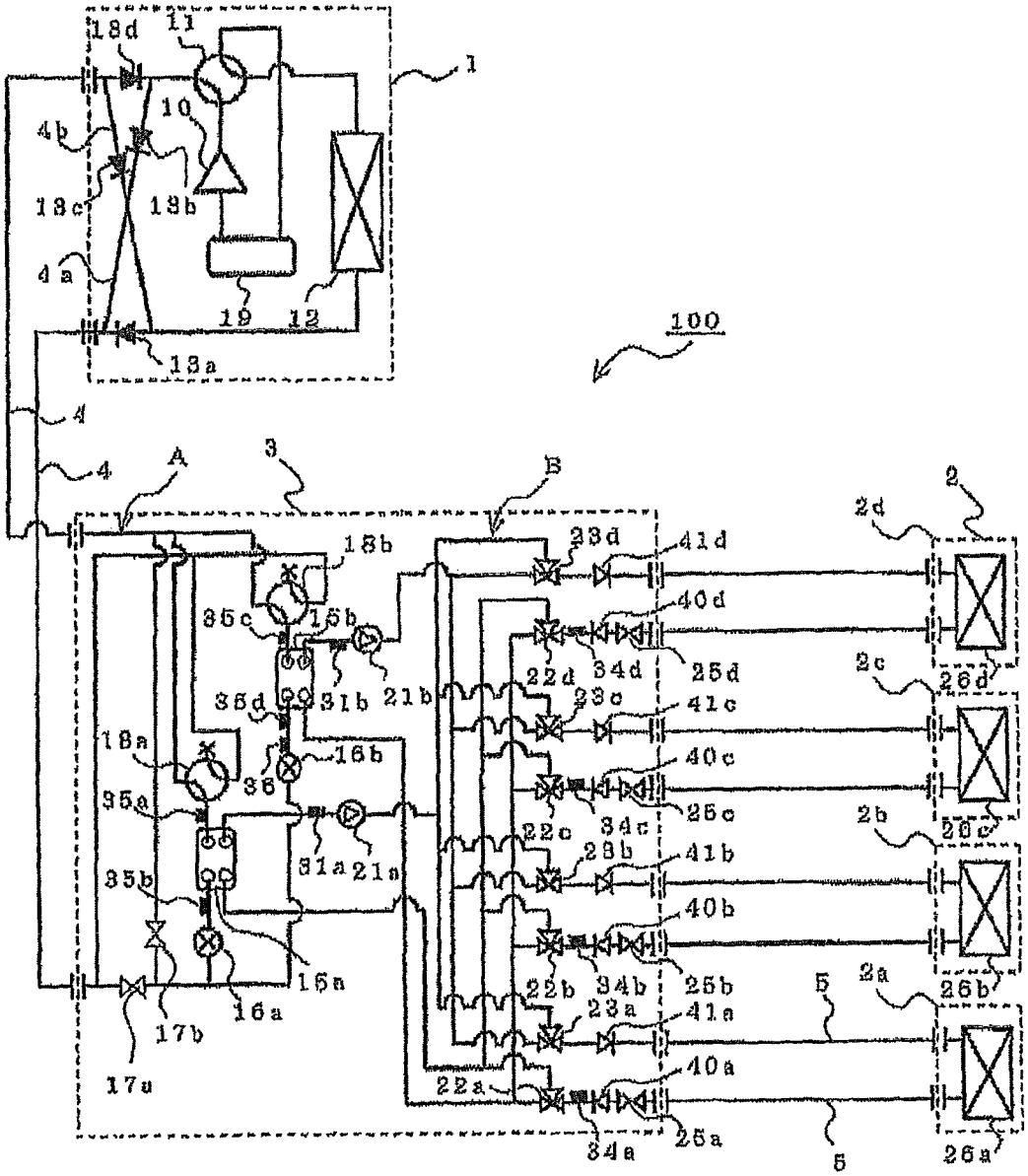
FIG. 2 is a schematic diagram illustrating an exemplary circuit configuration of the air-conditioning apparatus according to Embodiment 1 of the invention.

FIG. 2 is a schematic diagram illustrating an exemplary circuit configuration of the air-conditioning apparatus (hereinafter, referred to as an "air-conditioning apparatus 100") according to Embodiment 1 of the invention.

As illustrated in FIG. 2, the outdoor unit 1 and the heat medium relay unit 3 are connected to each of a heat exchanger related to heat medium 15*a* and a heat exchanger related to heat medium 15*b* included in the heat medium relay unit 3 with a refrigerant circuit A described later. Here, the refrigerant circuit A refers to a refrigerant circuit, in the heat medium relay unit 3, formed by connecting each component with refrigerant pipes in which the refrigerant that exchanges heat with the heat medium in each of the heat exchanger related to heat medium 15*a* and the heat exchanger related to heat medium 15*b* flows, as well as the refrigerant pipes 4 connecting the outdoor unit 1 and the heat medium relay unit 3. Specifically, the refrigerant circuit A includes, as will be described later, a compressor 10, a first refrigerant flow switching device 11, a heat source side heat exchanger 12, on-off devices 17, second refrigerant flow switching devices 18, refrigerant passages of the heat exchangers related to heat medium 15, throttle devices 16, and an accumulator 19 that are connected with refrigerant pipes. The connection relationship between each of the components described above constituting the refrigerant circuit A will be described in detail later.

Further, in Embodiment 1, as the refrigerant flowing in the refrigerant circuit A, R410A, R407c, R404A, carbon dioxide ($CO_2$), tetrafluoropropene, HC, or the like is used.

Furthermore, the heat medium relay unit 3 and the indoor units 2 are connected to each of the heat exchanger related to heat medium 15*a* and the heat exchanger related to heat medium 15*b* included in the heat medium relay unit 3 with the heat medium circuit B described later. Here, the heat medium circuit B refers to a heat medium circuit, in the heat medium relay unit 3, formed by connecting each component with heat medium pipes in which the heat medium that exchanges heat with the refrigerant in each of the heat exchanger related to heat medium 15*a* and the heat exchanger related to heat medium 15*b* flows, as well as the heat medium pipes 5 connecting the heat medium relay unit 3 and each indoor units 2. Specifically, the heat medium circuit B includes heat medium passages of the heat exchangers related to heat medium 15 and, as will be described later, pumps 21, first heat medium flow switching devices 22, heat medium flow control devices 25, use side heat exchangers 26, and second heat medium flow switching devices 23 that are connected with the heat medium pipes. The connection relationship between each of the components described above constituting the heat medium circuit B will be described in detail later.

The configuration of each of the outdoor unit 1, the indoor units 2, and the heat medium relay unit 3 will be described below in detail with reference to FIG. 2.

(Configuration of Outdoor Unit 1)

The outdoor unit 1 includes the compressor 10, the first refrigerant flow switching device 11, such as a four-way valve, the heat source side heat exchanger 12, and the accumulator 19, which are connected in series with the refrigerant pipes. The outdoor unit 1 further includes a first connecting pipe 4*a*, a second connecting pipe 4*b*, a check valve 13*a*, a check valve 13*b*, a check valve 13*c*, and a check valve 13*d*. By providing the first connecting pipe 4*a*, the second connecting pipe 4*b*, the check valve 13*a*, the check valve 13*b*, the check valve 13*c*, and the check valve 13*d*, the refrigerant can be made to flow into the heat medium relay unit 3 in a constant direction through the refrigerant pipe 4 irrespective of the operation mode requested by the indoor units 2, as described below.

The compressor 10 sucks in and compresses a gas refrigerant into a high-temperature high-pressure state, and may include, for example, a capacity-controllable inverter compressor.

The first refrigerant flow switching device 11 switches between a refrigerant flow of a heating operation (of a heating only operation mode and a heating main operation mode, described later) and a refrigerant flow of a cooling operation (of a cooling only operation mode and a cooling main operation mode).

The heat source side heat exchanger 12 functions as an evaporator during the heating operation and functions as a condenser (or radiator) during the cooling operation, and exchanges heat between air supplied from an air-sending device (not shown) such as a fan and the refrigerant to evaporate or condense the refrigerant.

The accumulator 19 is provided on the suction side of the compressor 10 and retains excess refrigerant.

In the outdoor unit 1, the first connecting pipe 4*a* connects a refrigerant pipe that connects the first refrigerant flow switching device 11 and the check valve 13*d* described later, and a refrigerant pipe that connects the refrigerant pipe 4, which allows the refrigerant to flow out of the outdoor unit 1, and the check valve 13*a* described later.

In the outdoor unit 1, the second connecting pipe 4*b* connects a refrigerant pipe that connects the refrigerant pipe 4, which allows the refrigerant to flow into the outdoor unit 1, and the check valve 13*d* described later, and a refrigerant pipe that connects the heat source side heat exchanger 12 and the check valve 13*a* described later.

The check valve 13*a* is provided in a refrigerant pipe that connects the heat source side heat exchanger 12 and the refrigerant pipe 4, which allows the refrigerant to flow out of the outdoor unit 1. The check valve 13*a* allows the refrigerant to flow only in the direction from the heat source side heat exchanger 12 to the heat medium relay unit 3.

The check valve 13*b* is provided in the first connecting pipe 4*a* and allows the gas refrigerant discharged from the compressor 10 to flow only in the direction towards the heat medium relay unit 3 during the heating operation.

The check valve 13*c* is disposed in the second connecting pipe 4*b* and allows the refrigerant, returning from the heat medium relay unit 3, to flow only in the direction towards the heat source side heat exchanger 12 during the heating operation.

The check valve 13*d* is provided in a refrigerant pipe that connects the first refrigerant flow switching device 11 and the refrigerant pipe 4, which allows the refrigerant to flow into the outdoor unit 1. The check valve 13*d* allows the refrigerant to flow only in the direction from that refrigerant pipe 4 to the first refrigerant flow switching device 11.

Note that, as shown in FIG. 2, while an exemplary case is illustrated in which the first connecting pipe 4*a*, the second connecting pipe 4*b*, the check valve 13*a*, the check valve 13*b*, the check valve 13*c*, and the check valve 13*d* are provided in the outdoor unit 1, the arrangement is not limited to this case, and they do not necessarily have to be provided.

(Configuration of Indoor Unit 2)

The indoor units 2 each include a use side heat exchanger 26. Herein, the four indoor units 2 illustrated in FIG. 2 are designated as, from the bottom of the drawing, an indoor unit 2*a*, an indoor unit 2*b*, an indoor unit 2*c*, and indoor unit 2*d*. When each indoor unit is to be described without any distinction, it will be referred to as merely the "indoor unit 2". Further, the four use side heat exchangers 26 illustrated in FIG. 2 are designated as, corresponding to the indoor unit 2*a* to indoor unit 2*d* and from the bottom of the drawing, a use side heat exchanger 26*a*, a use side heat exchanger 26*b*, a use side heat exchanger 26*c*, and a use side heat exchanger 26*d*. When each use side heat exchanger is to be described without any distinction, it will be referred to as merely the "use side heat exchanger 26".

The use side heat exchangers 26 are each connected, with a heat medium pipe, to a heat medium pipe 5, through which the heat medium that has flowed out of the heat medium relay unit 3 is made to flow, and to a heat medium pipe 5, through which the heat medium flowing out of the indoor unit 2 is made to flow. Further, each of the use side heat exchangers 26 functions as a radiator during the heating operation and functions as a heat sink during the cooling operation, and exchanges heat between the indoor air supplied by an air-sending device (not shown), such as a fan, and the heat medium to generate heating air or cooling air that is to be supplied to the indoor space 7.

Note that, as in the case of FIG. 1, the number of connected indoor units 2 is not limited to four, which is illustrated in FIG. 2.

(Configuration of Heat Medium Relay Unit 3)

The heat medium relay unit 3 includes the two heat exchangers related to heat medium 15, the two throttle devices 16, the two on-off devices 17, the two second refrigerant flow switching devices 18, the two pumps 21, the four first heat medium flow switching devices 22, the four second heat medium flow switching devices 23, the four heat medium flow control devices 25, four first backflow prevention devices 40, and four second backflow prevention devices 41.

The two heat exchangers related to heat medium 15 illustrated in FIG. 2 are designated as the heat exchanger related to heat medium 15*a* and the heat exchanger related to heat medium 15*b*. When each heat exchanger related to heat medium is to be described without any distinction, it will be referred to as merely the "heat exchanger related to heat medium 15".

Further, the two throttle devices 16 illustrated in FIG. 2 are designated as a throttle device 16*a* and a throttle device 16*b*. When each throttle device is to be described without any distinction, it will be referred to as merely the "throttle device 16".

Note that the throttle device 16 corresponds to an "expansion device" in the invention.

Further, the two on-off devices 17 illustrated in FIG. 2 are designated as an on-off device 17*a* and an on-off device 17*b*. When each on-off device is to be described without any distinction, it will be referred to as merely the "on-off device 17".

Furthermore, the two second refrigerant flow switching devices 18 illustrated in FIG. 2 are designated as a second refrigerant flow switching device 18*a* and a second refrigerant flow switching device 18*b*. When each second refrigerant flow switching device is to be described without any distinction, it will be referred to as merely the "second refrigerant flow switching device 18".

Further, the two pumps 21 illustrated in FIG. 2 are designated as a pump 21*a* and a pump 21*b*. When each pump is to be described without any distinction, it will be referred to as merely the "pump 21".

Further, the four first heat medium flow switching devices 22 illustrated in FIG. 2 are designated as, corresponding to the indoor unit 2*a* to indoor unit 2*d* and from the bottom of the drawing, a first heat medium flow switching device 22*a*, a first heat medium flow switching device 22*b*, a first heat medium flow switching device 22*c*, and a first heat medium flow switching device 22*d*.

Note that the first heat medium flow switching device 22 corresponds to a "heat medium flow switching device" of the invention.

Further, the four second heat medium flow switching devices 23 illustrated in FIG. 2 are designated as, corresponding to the indoor unit 2*a* to indoor unit 2*d* and from the bottom of the drawing, a second heat medium flow switching device 23*a*, a second heat medium flow switching device 23*b*, a second heat medium flow switching device 23*c*, and a second heat medium flow switching device 23*d*.

Furthermore, the four heat medium flow control devices 25 illustrated in FIG. 2 are designated as, corresponding to the indoor unit 2*a* to indoor unit 2*d* and from the bottom of the drawing, a heat medium flow control device 25*a*, a heat medium flow control device 25*b*, a heat medium flow control device 25*c*, and a heat medium flow control device 25*d*.

Still further, the four first backflow prevention devices 40 illustrated in FIG. 2 are designated as, corresponding to the indoor unit 2*a* to indoor unit 2*d* and from the bottom of the drawing, a first backflow prevention device 40*a*, a first backflow prevention device 40*b*, a first backflow prevention device 40*c*, and a first backflow prevention device 40*d*.

Additionally, the four second backflow prevention devices 41 illustrated in FIG. 2 are designated as, corresponding to the indoor unit 2*a* to indoor unit 2*d* and from the bottom of the drawing, a second backflow prevention device 41*a*, a second backflow prevention device 41*b*, a second backflow prevention device 41*c*, and a second backflow prevention device 41*d*.

The heat exchanger related to heat medium 15 functions as a condenser (or a radiator) or an evaporator and exchanges heat between the refrigerant and the heat medium in order to transfer cooling energy or heating energy, generated in the outdoor unit 1 and stored in the refrigerant, to the heat medium. The heat exchanger related to heat medium 15*a* is disposed between the throttle device 16*a* and the second refrigerant flow switching device 18*a* in the refrigerant circuit A and is used to heat the heat medium in the heating only operation mode described later and is used to cool the heat medium in the cooling only operation mode, the cooling main operation mode, and the heating main operation mode that will be described later. The heat exchanger related to heat medium 15*b* is disposed between the throttle device 16*b* and the second refrigerant flow switching device 18*b* in the refrigerant circuit A and is used to cool the heat medium in the cooling only operation mode described later and is used to heat the heat medium in the heating only operation mode, the cooling main operation mode, and the heating main operation mode that will be described later.

The throttle device 16 in the refrigerant circuit A has functions of a reducing valve and an expansion valve and is configured to decompress and expand the refrigerant. The throttle device 16*a* is provided on the upstream side of the heat exchanger related to heat medium 15*a*, upstream with respect to the refrigerant flow during the cooling operation. The throttle device 16*a* is connected to the on-off device 17*a* with the refrigerant pipes. The throttle device 16*b* is provided on the downstream side of the heat exchanger related to heat medium 15*b*, downstream with respect to the heat refrigerant flow during the heating operation. The throttle device 16*b* is connected to the on-off device 17*a* with the refrigerant pipes. The throttle device 16 may include a component having a variably controllable opening degree, such as an electronic expansion valve.

The on-off device 17 includes, for example, a two-way valve and is configured to open or close the refrigerant pipe in the refrigerant circuit A. One port of the on-off device 17*a* is connected to the refrigerant pipe 4, which allows the refrigerant to flow into the heat medium relay unit 3, and the other port thereof is connected to the throttle device 16*a* and the throttle device 16*b*. One port of the on-off device 17*b* is connected to the refrigerant pipe 4, which allows the refrigerant to flow out from the heat medium relay unit 3, and the other port thereof is connected to the on-off device 17*a* on the connecting port side that is connected to the throttle device 16.

The second refrigerant flow switching device 18 includes, for example, a four-way valve and switches passages of the refrigerant in the refrigerant circuit A in accordance with the operation mode. The second refrigerant flow switching device 18*a* is disposed on the downstream side of the heat exchanger related to heat medium 15*a*, downstream with respect to the refrigerant flow during the cooling operation. The second refrigerant flow switching device 18*b* is disposed on the upstream side of the heat exchanger related to heat medium 15*b*, upstream with respect to the refrigerant flow during the heating operation.

The pump 21 circulates the heat medium in the heat medium circuit B. The pump 21*a* is provided in the heat medium pipe between the heat exchanger related to heat medium 15*a* and the second heat medium flow switching devices 23. The pump 21*b* is provided in the heat medium pipe between the heat exchanger related to heat medium 15*b* and the second heat medium flow switching devices 23. The pump 21 may include, for example, a capacity-controllable pump.

Each first heat medium flow switching device 22 includes, for example, a three-way valve and switches passages of the heat medium in the heat medium circuit B in accordance with the operation mode. Further, the first heat medium flow switching devices 22 are arranged so that the number thereof (four in the case of FIG. 2) corresponds to the installed number of indoor units 2. Furthermore, among the three ports of each first heat medium flow switching device 22, one port is connected to the heat exchanger related to heat medium 15*a*, another port is connected to the heat exchanger related to heat medium 15*b*, and the remaining port is connected to the corresponding first backflow prevention device 40.

Each second heat medium flow switching device 23 includes, for example, a three-way valve and switches passages of the heat medium in the heat medium circuit B in accordance with the operation mode. Further, the second heat medium flow switching devices 23 are arranged so that the number thereof (four in the case of FIG. 2) corresponds to the installed number of indoor units 2. Furthermore, among the three ports of each second heat medium flow switching device 23, one port is connected to the pump 21*a*, another port is connected to the pump 21*b*, and the remaining port is connected to the corresponding second backflow prevention device 41.

Each heat medium flow control device 25 includes a two-way valve that can control its opening area and controls the flow rate of the heat medium flowing in the corresponding use side heat exchanger 26 (heat medium pipe 5) in the heat medium circuit B. Further, heat medium flow control devices 25 are arranged so that the number thereof (four in the case of FIG. 2) corresponds to the installed number of indoor units 2. Furthermore, one port of each heat medium flow control device 25 is connected to the heat medium pipe 5, which allows the heat medium that has flowed out of the use side heat exchanger 26 of the corresponding indoor unit 2 to flow into the heat medium relay unit 3, and the other port is connected to the corresponding first backflow prevention device 40.

Note that while each heat medium flow control device 25 is disposed in the heat medium pipeline on the outlet side of the heat medium passage of the corresponding use side heat exchanger 26 as described above, the disposition is not limited to this and each heat medium flow control device 25 may be disposed in the heat medium pipeline on the inlet side of the corresponding use side heat exchanger 26 (between the corresponding second backflow prevention device 41 and heat medium pipe 5, which allows the heat medium that has flowed out of the heat medium relay unit 3 to flow into the use side heat exchanger 26 of the corresponding indoor unit 2, for example).

Each first backflow prevention device 40 includes a check valve and is disposed between the corresponding first heat medium flow switching device 22 and heat medium flow control device 25. Further, each first backflow prevention device 40 allows the heat medium to flow only in the direction from the corresponding heat medium flow control device 25 to the corresponding first heat medium flow switching device 22. That is, the first backflow prevention device 40 prevents the heat medium from flowing from the first heat medium flow switching device 22 towards the heat medium flow control device 25.

Note that, as shown in FIG. 2, each first backflow prevention device 40 is constituted in a housing separate from that of the first heat medium flow switching device 22 and the heat medium flow control device 25; however, each first backflow prevention device 40 may be built into the corresponding first heat medium flow switching device 22 or heat medium flow control device 25.

Each second backflow prevention device 41 includes a check valve and is disposed between the corresponding second heat medium flow switching device 23 and heat medium pipe 5, which allows the heat medium that has flowed out of the heat medium relay unit 3 to flow into the use side heat exchanger 26 of the indoor unit 2. Each second backflow prevention device 41 allows the heat medium to flow only in the direction from the corresponding second heat medium flow switching device 23 towards the corresponding use side heat exchanger 26. That is, the second backflow prevention device 41 prevents the heat medium from flowing from the use side heat exchanger 26 towards the second heat medium flow switching device 23.

Note that, as shown in FIG. 2, each second backflow prevention device 41 is constituted in a housing separate from that of the second heat medium flow switching device 23; however, each second backflow prevention device 41 may be built into the corresponding second heat medium flow switching device 23.

The heat medium relay unit 3 includes two first temperature sensors 31, four second temperature sensors 34, four third temperature sensors 35, and a pressure sensor 36. Information (temperature information and pressure information) detected by these detection devices is transmitted to a controller (not shown) that controls the operation of the air-conditioning apparatus 100. The controller includes a microcomputer or the like and, on the basis of these pieces of information and operation information from a remote control and the like, implements the various operation modes described later by controlling the drive frequency of the compressor 10, the rotation speed of the air-sending device (not shown), the switching of the refrigerant passage of the first refrigerant flow switching device 11 and the second refrigerant flow switching devices 18, the drive frequency of the pumps 21, the switching of the heat medium passage of the first heat medium flow switching devices 22 and the second heat medium flow switching devices 23, and the flow rate of the heat medium of the heat medium flow control devices 25.

Note that the controller may be provided in each indoor unit 2, or may be provided in the outdoor unit 1 or the heat medium relay unit 3.

The four second temperature sensors 34 illustrated in FIG. 2 are designated as, corresponding to the indoor unit 2*a* to indoor unit 2*d* and from the bottom of the drawing, a second temperature sensor 34*a*, a second temperature sensor 34*b*, a second temperature sensor 34*c*, and a second temperature sensor 34*d*.

Each of the two first temperature sensors 31 (a first temperature sensor 31*a* and a first temperature sensor 31*b*) detects the temperature of the heat medium flowing out of the corresponding heat exchanger related to heat medium 15, that is, the temperature of the heat medium in the heat medium outlet side of the corresponding heat exchanger related to heat medium 15, and may include, for example, a thermistor. The first temperature sensor 31*a* is disposed in the heat medium pipe on the inlet side of the pump 21*a*. The first temperature sensor 31*b* is disposed in the heat medium pipe on the inlet side of the pump 21*b*.

Each second temperature sensor 34 is disposed between the corresponding first heat medium flow switching device 22 and heat medium flow control device 25 and detects the temperature of the heat medium flowing out of the corresponding use side heat exchanger 26. A thermistor or the like, for example, may be used as the second temperature sensor 34. Further, each second temperature sensor 34 is arranged so that the number thereof (four in the case of FIG. 2) corresponds to the installed number of indoor units 2.

Each of the third temperature sensor 35*a* and the third temperature sensor 35*c* is disposed between the corresponding heat exchanger related to heat medium 15 and second refrigerant flow switching device 18, detects the temperature of the refrigerant flowing in or out of the corresponding heat exchanger related to heat medium 15, and may include, for example, a thermistor. Each of the third temperature sensor 35*b* and the third temperature sensor 35*d* is disposed between the corresponding heat exchanger related to heat medium 15 and throttle device 16, detects the temperature of the refrigerant flowing in or out of the corresponding heat exchanger related to heat medium 15, and may include, for example, a thermistor.

Similar to the installation position of the third temperature sensor 35*d*, the pressure sensor 36 is disposed between the heat exchanger related to heat medium 15*b* and the throttle device 16*b*, and detects the pressure of the refrigerant flowing between the heat exchanger related to heat medium 15*b* and the throttle device 16*b*.

The controller described above can perform selective control between allowing the heat medium flowing from the heat exchanger related to heat medium 15*a* to flow into the use side heat exchanger 26 and allowing the heat medium flowing from the heat exchanger related to heat medium 15*b* to flow into the use side heat exchanger 26 by controlling the heat medium passage of each of the first heat medium flow switching devices 22 and the second heat medium flow switching devices 23. That is, the controller controls the heat medium passage of each of the first heat medium flow switching devices 22 and the second heat medium flow switching devices 23 such that the passage on the inflow side and that on the outflow side of each of the use side heat exchangers 26 are allowed to be in communication with the heat exchanger related to heat medium 15*a* or the heat exchanger related to heat medium 15*b* selectively.

As described above, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3, and the heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* are each configured to exchange heat between the refrigerant circulating in the refrigerant circuit A and the heat medium circulating in the heat medium circuit B. Accordingly, the heat medium, such as water, brine, or the like, is circulated in the indoor units 2 and no refrigerant is circulated therein; hence, an air-conditioning apparatus 100 having improved safety in which refrigerant does not leak into the indoor space 7 or the like can be obtained.

The various operation modes implemented by the air-conditioning apparatus 100 will now be described. On the basis of an instruction from each indoor unit 2, the air-conditioning apparatus 100 is capable of carrying out a cooling operation or a heating operation in the indoor unit 2. Specifically, the air-conditioning apparatus 100 is configured to allow all of the indoor units 2 to perform the same operation, as well as allowing each of the indoor units 2 to perform different operations.

The operation modes implemented by the air-conditioning apparatus 100 include the cooling only operation mode in which all of the operating indoor units 2 carry out the cooling operation, the heating only operation mode in which all of the operating indoor units 2 carry out the heating operation, the cooling main operation mode in which cooling load is larger, and the heating main operation mode in which heating load is larger. The various operation modes will be described below with respect to the flow of the heat source side refrigerant and that of the heat medium.

(Cooling Only Operation Mode)

Figure 3:
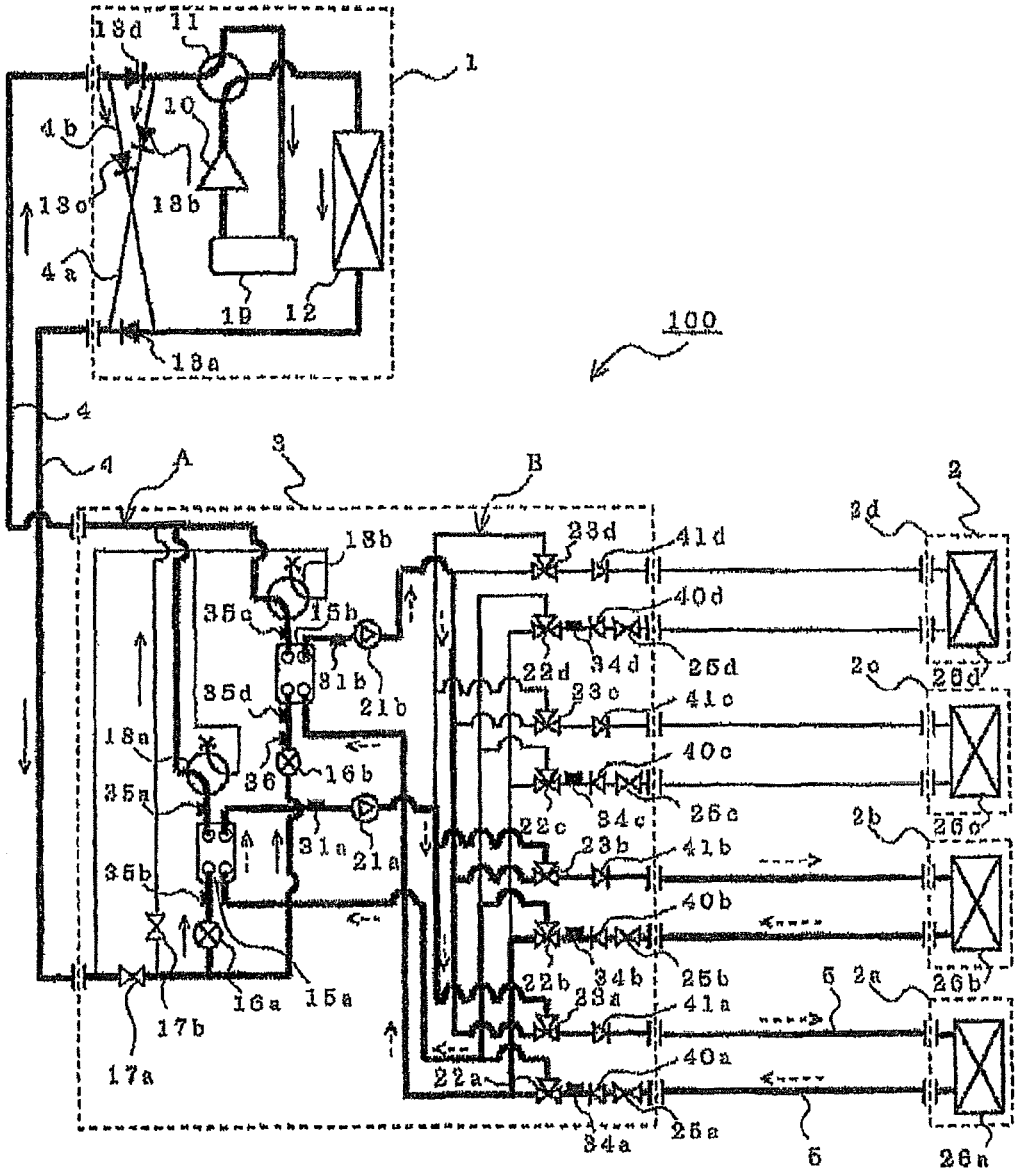
FIG. 3 is a refrigerant circuit diagram illustrating flows of refrigerants in a cooling only operation mode of an air-conditioning apparatus 100 according to Embodiment 1 of the invention.

FIG. 3 is a refrigerant circuit diagram illustrating flows of refrigerants in a cooling only operation mode of the air-conditioning apparatus 100 according to Embodiment 1 of the invention. The cooling only operation mode will be described with respect to a case in which cooling loads are generated only in the use side heat exchanger 26*a* and the use side heat exchanger 26*b* in FIG. 3. Furthermore, in FIG. 3, pipes indicated by thick lines correspond to pipes through which the refrigerant flows and pipes through which the heat medium flows. The direction of flow of the refrigerant is indicated by solid-line arrows and the direction of flow of the heat medium is indicated by broken-line arrows.

In the cooling only operation mode illustrated in FIG. 3, the controller switches the refrigerant passage with the first refrigerant flow switching device 11 such that the gas refrigerant discharged from the compressor 10 flows into the heat source side heat exchanger 12 in the outdoor unit 1. Further, the controller performs an opening and closing control such that the on-off device 17*a* is in an opened state and the on-off device 17*b* is in a closed state. In the heat medium relay unit 3, the controller drives the pump 21*a* and the pump 21*b*, opens the heat medium flow control device 25*a* and the heat medium flow control device 25*b*, and totally closes the heat medium flow control device 25*c* and the heat medium flow control device 25*d* such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the refrigerant in the refrigerant circuit A will be described with reference to FIG. 3. A low-temperature low-pressure gas refrigerant is compressed by the compressor 10 and is discharged as a high-temperature high-pressure gas refrigerant. The high-temperature high-pressure gas refrigerant that has been discharged from the compressor 10 flows through the first refrigerant flow switching device 11 into the heat source side heat exchanger 12. The gas refrigerant that has flowed into the heat source side heat exchanger 12 is condensed into a high-pressure liquid refrigerant while rejecting heat to the outdoor air. The high-pressure liquid refrigerant that has flowed out of the heat source side heat exchanger 12 passes through the check valve 13*a*, flows out of the outdoor unit 1, and flows into the heat medium relay unit 3 through the refrigerant pipe 4.

The high-pressure liquid refrigerant that has flowed into the heat medium relay unit 3 is branched after passing through the on-off device 17*a* and flows into each of the throttle device 16*a* and the throttle device 16*b*. The high-pressure liquid refrigerant that has flowed into the throttle device 16*a* and the throttle device 16*b* is expanded and reduced in pressure, and becomes a low-temperature low-pressure two-phase gas-liquid refrigerant. This low-temperature low-pressure two-phase gas-liquid refrigerant flows into each of the heat exchanger related to heat medium 15*a* and the heat exchanger related to heat medium 15*b*, acting as evaporators, removes heat from the heat medium circulating in the heat medium circuit B, cools the heat medium while being evaporated, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding second refrigerant flow switching device 18*a* and second refrigerant flow switching device 18*b*, and flows into the outdoor unit 1 again through the refrigerant pipe 4.

The gas refrigerant that has flowed into the outdoor unit 1 passes through the check valve 13*d* and is sucked into the compressor 10 again via the first refrigerant flow switching device 11 and the accumulator 19.

At this time, the controller controls the opening degree of the throttle device 16*a* such that superheat (degree of superheat) obtained as the difference between a temperature detected by the third temperature sensor 35*a* and that detected by the third temperature sensor 35*b* is constant. Similarly, the controller controls the opening degree of the throttle device 16*b* such that superheat obtained as the difference between a temperature detected by the third temperature sensor 35*c* and that detected by the third temperature sensor 35*d* is constant.

Next, the flow of the heat medium in the heat medium circuit B will be described with reference to FIG. 3. In the cooling only operation mode, both the heat exchanger related to heat medium 15*a* and the heat exchanger related to heat medium 15*b* transfer cooling energy of the refrigerant to the heat medium, and the cooled heat medium is made to flow in the heat medium circuit B with the pump 21*a* and the pump 21*b*.

A portion of the heat medium, which has flowed out of each of the pump 21*a* and the pump 21*b* while being pressurized, flows out of the heat medium relay unit 3 through the second heat medium flow switching device 23*a* and the second backflow prevention device 41*a*, and flows into the indoor unit 2*a* through the heat medium pipe 5. The remaining portion of the heat medium, which has flowed out of each of the pump 21*a* and the pump 21*b* while being pressurized, flows out of the heat medium relay unit 3 through the second heat medium flow switching device 23*b* and the second backflow prevention device 41*b*, and flows into the indoor unit 2*b* through the heat medium pipe 5. Here, since the heat medium flow control device 25*c* and the heat medium flow control device 25*d* are in a totally closed state, the heat medium does not flow into the indoor unit 2*c* through the second heat medium flow switching device 23*c* and the second backflow prevention device 41*c*, and into the indoor unit 2*d* through the second heat medium flow switching device 23*d* and the second backflow prevention device 41*d*.

The heat medium that has flowed into the indoor unit 2*a* and the indoor unit 2*b* flows into the use side heat exchanger 26*a* and the use side heat exchanger 26*b*, respectively. The heat medium that has flowed into the use side heat exchanger 26*a* and the use side heat exchanger 26*b* removes heat from the indoor air; hence, cooling of the indoor space 7 is carried out. Further, the heat medium that has flowed out of the use side heat exchanger 26*a* and the use side heat exchanger 26*b* flows out of the indoor unit 2*a* and the indoor unit 2*b*, respectively, and flows into the heat medium relay unit 3 through the heat medium pipes 5.

The heat medium that has flowed into the heat medium relay unit 3 flows into the heat medium flow control device 25*a* and the heat medium flow control device 25*b*. At this time, with the function of the heat medium flow control device 25*a* and the heat medium flow control device 25*b*, the flow rate of the heat medium flowing into each of the use side heat exchanger 26*a* and the use side heat exchanger 26*b* is controlled to a flow rate that is sufficient to cover an air conditioning load required indoors. The heat medium that has flowed out of the heat medium flow control device 25*a* passes through the first backflow prevention device 40*a* and the first heat medium flow switching device 22*a* and flows into the heat exchanger related to heat medium 15*a* and the heat exchanger related to heat medium 15*b*. Similarly, the heat medium that has flowed out of the heat medium flow control device 25*b* passes through the first backflow prevention device 40*b* and the first heat medium flow switching device 22*b* and flows into the heat exchanger related to heat medium 15*a* and the heat exchanger related to heat medium 15*b*. The heat medium that has flowed into the heat exchanger related to heat medium 15*a* and the heat exchanger related to heat medium 15*b* is sucked again into the pump 21*a* and the pump 21*b*, respectively. At this time, each of the respective first heat medium flow switching device 22 and second heat medium flow switching device 23 is set to an intermediate opening degree such that passages to both of the heat exchanger related to heat medium 15*a* and the heat exchanger related to heat medium 15*b* are established.

Further, the air conditioning load required in the indoor space 7 can be covered by maintaining the difference between a temperature detected by the first temperature sensor 31*a* or a temperature detected by the first temperature sensor 31*b* and a temperature detected by the second temperature sensor 34 at a target value. Furthermore, although the cooling operation of the use side heat exchanger 26 should essentially be controlled with the temperature difference between its inlet and its outlet, since the temperature of the heat medium on the inlet side of the use side heat exchanger 26 is substantially the same as that detected by the first temperature sensor 31*b*, the number of temperature sensors can be reduced by using the first temperature sensor 31. As such, it is possible to construct the system inexpensively.

As regards the temperature at the outlet of the heat exchanger related to heat medium 15, either of the temperature detected by the first temperature sensor 31*a* or that detected by the first temperature sensor 31*b* may be used. Alternatively, the mean temperature of the two may be used.

Upon implementing the cooling only operation mode described above, since it is unnecessary to supply the heat medium to each use side heat exchanger 26 having no heat load (including thermo-off), the heat medium is not allowed to flow into the corresponding use side heat exchanger 26 by closing the passage with the corresponding heat medium flow control device 25. Referring to FIG. 3, the heat medium is supplied to the use side heat exchanger 26*a* and the use side heat exchanger 26*b* because these use side heat exchangers have heat loads. However, the use side heat exchanger 26*c* and the use side heat exchanger 26*d* do not have any heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

(Heating Only Operation Mode)

Figure 4:
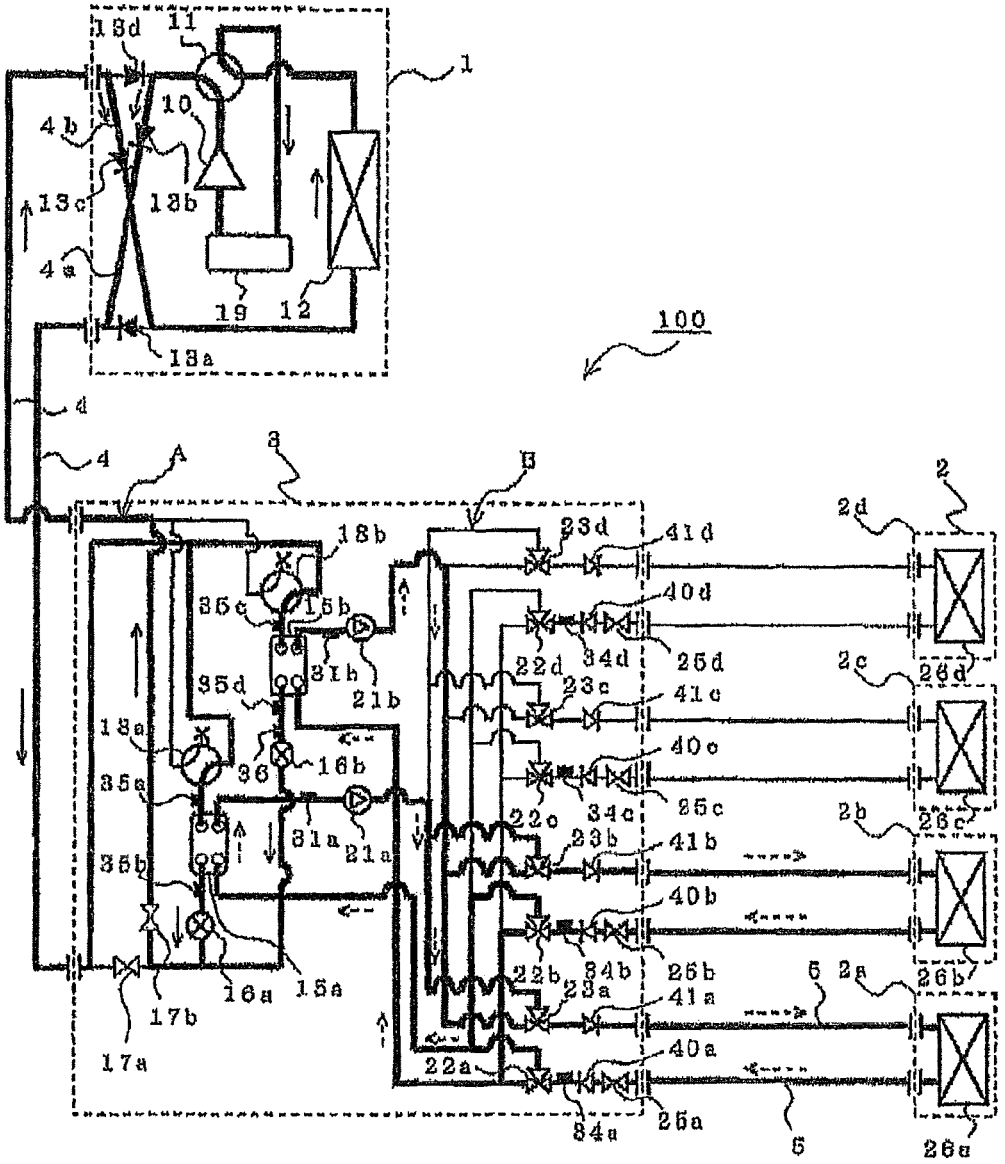
FIG. 4 is a refrigerant circuit diagram illustrating flows of refrigerants in a heating only operation mode of the air-conditioning apparatus 100 according to Embodiment 1 of the invention.

FIG. 4 is a refrigerant circuit diagram illustrating flows of refrigerants in the heating only operation mode of the air-conditioning apparatus 100 according to Embodiment 1 of the invention. The heating only operation mode will be described with respect to a case in which heating loads are generated only in the use side heat exchanger 26*a* and the use side heat exchanger 26*b* in FIG. 4. Furthermore, in FIG. 4, pipes indicated by thick lines correspond to pipes through which the refrigerant flows and pipes through which the heat medium flows. The direction of flow of the refrigerant is indicated by solid-line arrows and the direction of flow of the heat medium is indicated by broken-line arrows.

In the heating only operation mode illustrated in FIG. 4, the controller switches the refrigerant passage with the first refrigerant flow switching device 11 such that the gas refrigerant discharged from the compressor 10 flows into the heat medium relay unit 3 without passing through the heat source side heat exchanger 12 in the outdoor unit 1. Further, the controller performs an opening and closing control such that the on-off device 17*a* is in a closed state and the on-off device 17*b* is in an opened state. In the heat medium relay unit 3, the controller drives the pump 21*a* and the pump 21*b*, opens the heat medium flow control device 25*a* and the heat medium flow control device 25*b*, and totally closes the heat medium flow control device 25*c* and the heat medium flow control device 25*d* such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the refrigerant in the refrigerant circuit A will be described with reference to FIG. 4. A low-temperature low-pressure gas refrigerant is compressed by the compressor 10 and is discharged as a high-temperature high-pressure gas refrigerant. The high-temperature high-pressure gas refrigerant that has been discharged from the compressor 10 passes through the check valve 13*b* in the first connecting pipe 4*a* via the first refrigerant flow switching device 11 and flows out of the outdoor unit 1. The high-temperature high-pressure gas refrigerant that has flowed out of the outdoor unit 1 flows into the heat medium relay unit 3 via the refrigerant pipe 4.

The high-temperature high-pressure gas refrigerant that has flowed into the heat medium relay unit 3 is branched, passes through each of the second refrigerant flow switching device 18*a* and the second refrigerant flow switching device 18*b*, and flows into the corresponding heat exchanger related to heat medium 15*a* and the heat exchanger related to heat medium 15*b* that are functioning as condensers. The high-temperature high-pressure gas refrigerant that has flowed into each of the heat exchanger related to heat medium 15*a* and the heat exchanger related to heat medium 15*b* is condensed while heating the heat medium circulating in the heat medium circuit B by rejecting heat thereto, and is turned into a high-pressure liquid refrigerant. The high-pressure liquid refrigerant flowing out of each of the heat exchanger related to heat medium 15*a* and the heat exchanger related to heat medium 15*b* is expanded and decompressed into a low-temperature low-pressure two-phase gas-liquid refrigerant in the throttle device 16*a* and the throttle device 16*b*, respectively. This low-temperature low-pressure two-phase gas-liquid refrigerant flows out of the heat medium relay unit 3 through the on-off device 17*b*, and flows into the outdoor unit 1 again through the refrigerant pipe 4.

The two-phase gas-liquid refrigerant that has flowed into the outdoor unit 1 passes through the check valve 13*c* in the second connecting pipe 4*b* and flows into the heat source side heat exchanger 12. The two-phase gas-liquid refrigerant that has flowed into the heat source side heat exchanger 12 is gasified while receiving heat from the outdoor air and becomes a low-temperature low-pressure gas refrigerant. The low-temperature low-pressure gas refrigerant flowing out of the heat source side heat exchanger 12 is sucked into the compressor 10 again via the first refrigerant flow switching device 11 and the accumulator 19.

At this time, the controller controls the opening degree of the throttle device 16*a* such that subcooling (degree of subcooling) obtained as the difference between a value of a saturation temperature converted from a pressure detected by the pressure sensor 36 and a temperature detected by the third temperature sensor 35*b* is constant. Similarly, the controller controls the opening degree of the throttle device 16*b* such that the subcooling obtained as the difference between a value of the saturation temperature converted from the pressure detected by the pressure sensor 36 and a temperature detected by the third temperature sensor 35*d* is constant.

Note that when a temperature at a position in the middle of the heat exchanger related to heat medium 15 can be measured, the temperature at this position may be used instead of the pressure sensor 36. In such a case, the system can be constructed inexpensively.

Next, the flow of the heat medium in the heat medium circuit B will be described with reference to FIG. 4. In the heating only operation mode, both the heat exchanger related to heat medium 15*a* and the heat exchanger related to heat medium 15*b* transfer heating energy of the refrigerant to the heat medium, and the heated heat medium is made to flow in the heat medium circuit B with the pump 21*a* and the pump 21*b*.

A portion of the heat medium, which has flowed out of each of the pump 21*a* and the pump 21*b* while being pressurized, flows out of the heat medium relay unit 3 through the second heat medium flow switching device 23*a* and the second backflow prevention device 41*a*, and flows into the indoor unit 2*a* through the heat medium pipe 5. The remaining portion of the heat medium, which has flowed out of each of the pump 21*a* and the pump 21*b* while being pressurized, flows out of the heat medium relay unit 3 through the second heat medium flow switching device 23*b* and the second backflow prevention device 41*b*, and flows into the indoor unit 2*b* through the heat medium pipe 5. Here, since the heat medium flow control device 25*c* and the heat medium flow control device 25*d* are in a totally closed state, the heat medium does not flow into the indoor unit 2*c* through the second heat medium flow switching device 23*c* and the second backflow prevention device 41*c*, and into the indoor unit 2*d* through the second heat medium flow switching device 23*d* and the second backflow prevention device 41*d*.

The heat medium that has flowed into the indoor unit 2*a* and the indoor unit 2*b* flows into the use side heat exchanger 26*a* and the use side heat exchanger 26*b*, respectively. The heat medium that has flowed into the use side heat exchanger 26*a* and the use side heat exchanger 26*b* rejects heat to the air in the indoor unit; hence, heating of the indoor space 7 is carried out. Further, the heat medium that has flowed out of the use side heat exchanger 26*a* and the use side heat exchanger 26*b* flows out of the indoor unit 2*a* and the indoor unit 2*b*, respectively, and flows into the heat medium relay unit 3 through the heat medium pipes 5.

The heat medium that has flowed into the heat medium relay unit 3 flows into the heat medium flow control device 25*a* and the heat medium flow control device 25*b*. At this time, with the function of each of the heat medium flow control device 25*a* and the heat medium flow control device 25*b*, the flow rate of the heat medium flowing into each of the use side heat exchanger 26*a* and the use side heat exchanger 26*b* is controlled to a flow rate that is sufficient to cover an air conditioning load required indoors. The heat medium that has flowed out of the heat medium flow control device 25*a* passes through the first backflow prevention device 40*a* and the first heat medium flow switching device 22*a* and flows into the heat exchanger related to heat medium 15*a* and the heat exchanger related to heat medium 15*b*. Similarly, the heat medium that has flowed out of the heat medium flow control device 25*b* passes through the first backflow prevention device 40*b* and the first heat medium flow switching device 22*b* and flows into the heat exchanger related to heat medium 15*a* and the heat exchanger related to heat medium 15*b*. The heat medium that has flowed into the heat exchanger related to heat medium 15*a* and the heat exchanger related to heat medium 15*b* is sucked again into the pump 21*a* and the pump 21*b*, respectively. At this time, each of the respective first heat medium flow switching device 22 and second heat medium flow switching device 23 is set to an intermediate opening degree such that passages to both of the heat exchanger related to heat medium 15*a* and the heat exchanger related to heat medium 15*b* are established.

Further, the air conditioning load required in the indoor space 7 can be covered by maintaining the difference between a temperature detected by the first temperature sensor 31*a* or a temperature detected by the first temperature sensor 31*b* and a temperature detected by the second temperature sensor 34 at a target value. Furthermore, although the heating operation of the use side heat exchanger 26 should essentially be controlled with the temperature difference between its inlet and its outlet, since the temperature of the heat medium on the inlet side of the use side heat exchanger 26 is substantially the same as that detected by the first temperature sensor 31, the number of temperature sensors can be reduced by using the first temperature sensor 31. As such, it is possible to construct the system inexpensively.

As regards the temperature at the outlet of the heat exchanger related to heat medium 15, either of the temperature detected by the first temperature sensor 31*a* or that detected by the first temperature sensor 31*b* may be used. Alternatively, the mean temperature of the two may be used.

Upon implementing the heating only operation mode described above, since it is unnecessary to supply the heat medium to each use side heat exchanger 26 having no heat load (including thermo-off), the heat medium is not allowed to flow into the corresponding use side heat exchanger 26 by closing the passage with the corresponding heat medium flow control device 25. In FIG. 4, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

(Cooling Main Operation Mode)

Figure 5:
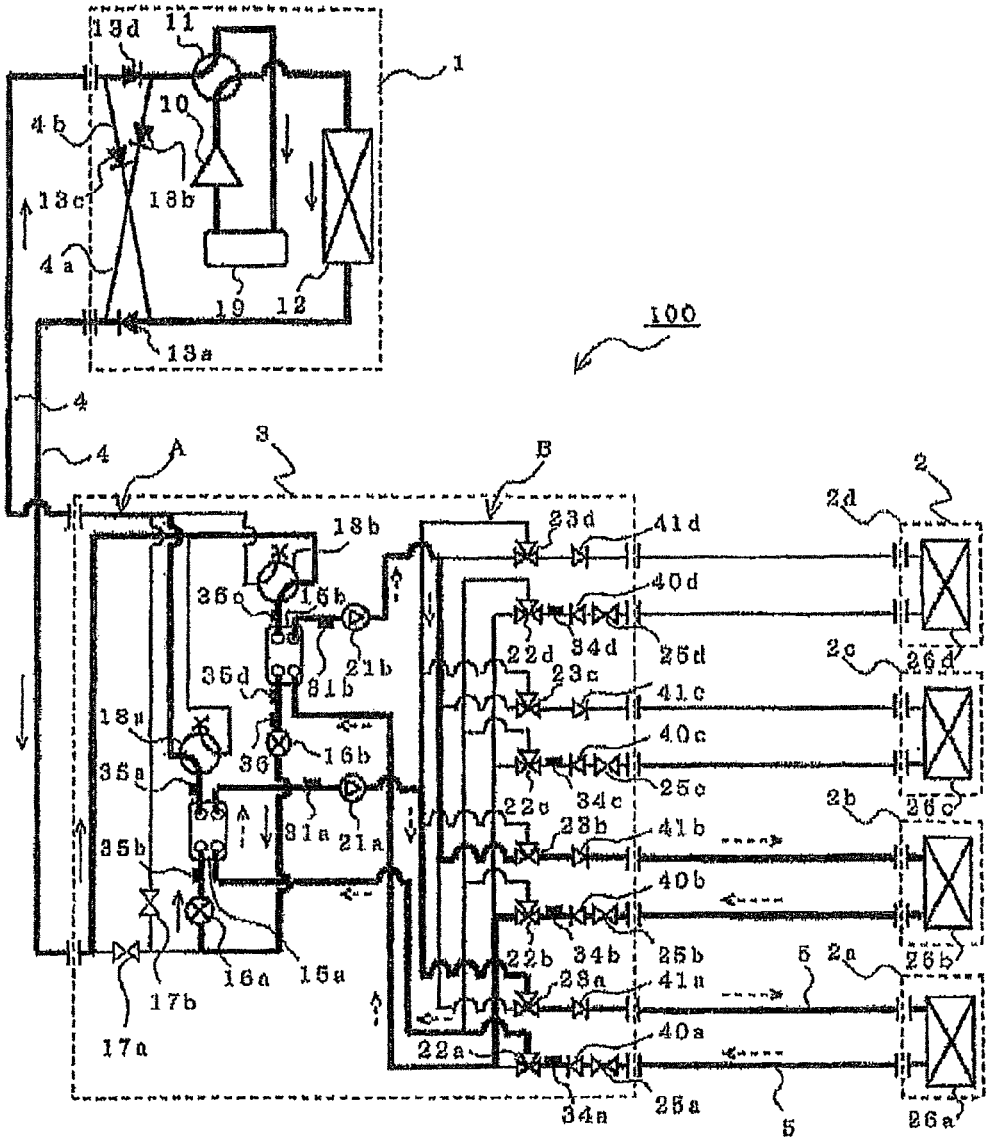
FIG. 5 is a refrigerant circuit diagram illustrating flows of refrigerants in a cooling main operation mode of the air-conditioning apparatus 100 according to Embodiment 1 of the invention.

FIG. 5 is a refrigerant circuit diagram illustrating flows of the refrigerants in the cooling main operation mode of the air-conditioning apparatus 100 according to Embodiment 1 of the invention. Referring to FIG. 5, the cooling main operation mode will be described with respect to a case in which a cooling load is generated in the use side heat exchanger 26*a* and a heating load is generated in the use side heat exchanger 26*b*. Note that, in FIG. 5, pipes indicated by thick lines correspond to pipes through which the refrigerant flows and pipes through which the heat medium flows. The direction of flow of the refrigerant is indicated by solid-line arrows and the direction of flow of the heat medium is indicated by broken-line arrows.

In the cooling main operation mode illustrated in FIG. 5, the controller switches the refrigerant passage with the first refrigerant flow switching device 11 such that the gas refrigerant discharged from the compressor 10 flows into the heat source side heat exchanger 12 in the outdoor unit 1. Further, the controller performs an opening and closing control such that the throttle device 16*a* is in a fully opened state, the on-off device 17*a* is in a closed state, and the on-off device 17*b* is in a closed state. Furthermore, in the heat medium relay unit 3, the controller drives the pump 21*a* and the pump 21*b*, opens the heat medium flow control device 25*a* and the heat medium flow control device 25*b*, and totally closes the heat medium flow control device 25*c* and the heat medium flow control device 25*d* such that the heat medium circulates between the heat exchanger related to heat medium 15*a* and the use side heat exchanger 26*a*, and between the heat exchanger related to heat medium 15*b* and the use side heat exchanger 26*b*.

First, the flow of the refrigerant in the refrigerant circuit A will be described with reference to FIG. 5. A low-temperature low-pressure gas refrigerant is compressed by the compressor 10 and is discharged as a high-temperature high-pressure gas refrigerant. The high-temperature high-pressure gas refrigerant that has been discharged from the compressor 10 flows through the first refrigerant flow switching device 11 into the heat source side heat exchanger 12. The gas refrigerant that has flowed into the heat source side heat exchanger 12 is condensed into a two-phase gas-liquid refrigerant while rejecting heat to outdoor air. The two-phase gas-liquid refrigerant that has flowed out of the heat source side heat exchanger 12 passes through the check valve 13*a*, flows out of the outdoor unit 1, and flows into the heat medium relay unit 3 through the refrigerant pipe 4.

The two-phase gas-liquid refrigerant flowing into the heat medium relay unit 3 passes through the second refrigerant flow switching device 18*b* and flows into the heat exchanger related to heat medium 15*b* functioning as a condenser. The two-phase gas-liquid refrigerant that has flowed into the heat exchanger related to heat medium 15*b* is condensed while heating the heat medium circulating in the heat medium circuit B by rejecting heat thereto, and is turned into a liquid refrigerant. The liquid refrigerant flowing out of the heat exchanger related to heat medium 15*b* is expanded and decompressed into a low-temperature low-pressure two-phase gas-liquid refrigerant by the throttle device 16*b*. This low-temperature low-pressure two-phase gas-liquid refrigerant flows through the throttle device 16*a* and into the heat exchanger related to heat medium 15*a* functioning as an evaporator. The low-temperature low-pressure two-phase gas-liquid refrigerant that has flowed into the heat exchanger related to heat medium 15*a* removes heat from the heat medium circulating in the heat medium circuit B, cools the heat medium while being evaporated, and turns into a low-temperature low-pressure gas refrigerant. The gas refrigerant flowing out of the heat exchanger related to heat medium 15*a* passes through the second refrigerant flow switching device 18*a*, flows out of the heat medium relay unit 3, and flows into the outdoor unit 1 again through the refrigerant pipe 4.

The gas refrigerant that has flowed into the outdoor unit 1 passes through the check valve 13*d* and is sucked into the compressor 10 again via the first refrigerant flow switching device 11 and the accumulator 19.

At this time, the controller controls the opening degree of the throttle device 16*b* such that the superheat obtained as the difference between a temperature detected by the third temperature sensor 35*a* and that detected by the third temperature sensor 35*b* is constant.

Note that the controller may control the opening degree of the throttle device 16*b* such that the subcooling obtained as the difference between a value of the saturation temperature converted from the pressure detected by the pressure sensor 36 and a temperature detected by the third temperature sensor 35*d* is constant.

Alternatively, the throttle device 16*b* may be fully opened and the throttle device 16*a* may control the superheat or the subcooling described above.

Next, the flow of the heat medium in the heat medium circuit B will be described with reference to FIG. 5. In the cooling main operation mode, heating energy of the refrigerant is transferred to the heat medium in the heat exchanger related to heat medium 15*b*, and the heated heat medium is made to circulate in the heat medium circuit B by the pump 21*b*. Further, in the cooling main operation mode, cooling energy of the refrigerant is transferred to the heat medium in the heat exchanger related to heat medium 15*a*, and the cooled heat medium is made to circulate in the heat medium circuit B by the pump 21*a*.

The heat medium, which has flowed out of the pump 21*b* while being pressurized, flows out of the heat medium relay unit 3 through the second heat medium flow switching device 23*b* and the second backflow prevention device 41*b*, and flows into the indoor unit 2*b* through the heat medium pipe 5. The heat medium, which has flowed out of the pump 21*a* while being pressurized, flows out of the heat medium relay unit 3 through the second heat medium flow switching device 23*a* and the second backflow prevention device 41*a*, and flows into the indoor unit 2*a* through the heat medium pipe 5. Here, since the heat medium flow control device 25*c* and the heat medium flow control device 25*d* are in a totally closed state, the heat medium does not flow into the indoor unit 2*c* through the second heat medium flow switching device 23*c* and the second backflow prevention device 41*c*, and into the indoor unit 2*d* through the second heat medium flow switching device 23*d* and the second backflow prevention device 41*d*.

The heat medium that has flowed into the indoor unit 2*b* flows into the use side heat exchanger 26*b*, and the heat medium that has flowed into the indoor unit 2*a* flows into the use side heat exchanger 26*a*. The heat medium that has flowed into the use side heat exchanger 26*b* rejects heat to the indoor air; hence, heating of the indoor space 7 is carried out. Meanwhile, the heat medium that has flowed into the use side heat exchanger 26*a* removes heat from the indoor air; hence, cooling of the indoor space 7 is carried out. Further, the heat medium that has flowed out of the use side heat exchanger 26*b* with a decrease in temperature to a certain degree flows out of the indoor unit 2*b*, and flows into the heat medium relay unit 3 through the heat medium pipe 5. Meanwhile, the heat medium that has flowed out of the use side heat exchanger 26*a* with an increase in temperature to a certain degree flows out of the indoor unit 2*a*, and flows into the heat medium relay unit 3 through the heat medium pipe 5.

The heat medium that has flowed into the heat medium relay unit 3 from the use side heat exchanger 26*b* flows into the heat medium flow control device 25*b*, and the heat medium that has flowed into the heat medium relay unit 3 from the use side heat exchanger 26*a* flows into the heat medium flow control device 25*a*. At this time, with the function of each of the heat medium flow control device 25*a* and the heat medium flow control device 25*b*, the flow rate of the heat medium flowing into each of the use side heat exchanger 26*a* and the use side heat exchanger 26*b* is controlled to a flow rate that is sufficient to cover an air conditioning load required indoors. The heat medium that has flowed out of the heat medium flow control device 25*b* passes through the first backflow prevention device 40*b* and the first heat medium flow switching device 22*b*, flows into the heat exchanger related to heat medium 15*b*, and is sucked into the pump 21*b* again. Meanwhile, the heat medium that has flowed out of the heat medium flow control device 25*a* passes through the first backflow prevention device 40*a* and the first heat medium flow switching device 22*a*, flows into the heat exchanger related to heat medium 15*a*, and is sucked into the pump 21*a* again. As described above, in the cooling main operation mode, with the function of the first heat medium flow switching devices 22 and the second heat medium flow switching devices 23, the heated heat medium and the cooled heat medium are distributed to the respective use side heat exchangers 26 having a heating load and a cooling load, without being mixed.

Further, the air conditioning load required in the indoor space 7 is covered by controlling the temperature difference between the temperature detected by the first temperature sensor 31*b* and that detected by the second temperature sensor 34*b* at a target value as for the heating side, and is covered by controlling the temperature difference between the temperature detected by the second temperature sensor 34*b* and that detected by the first temperature sensor 31*a* at a target value as for the cooling side.

Upon implementing the cooling main operation mode described above, since it is unnecessary to supply the heat medium to each use side heat exchanger 26 having no heat load (including thermo-off), the heat medium is not allowed to flow into the corresponding use side heat exchanger 26 by closing the passage with the corresponding heat medium flow control device 25. Referring to FIG. 5, the heat medium is supplied to the use side heat exchanger 26*a* and the use side heat exchanger 26*b* because these use side heat exchangers have heat loads. However, the use side heat exchanger 26*c* and the use side heat exchanger 26*d* do not have any heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

(Heating Main Operation Mode)

Figure 6:
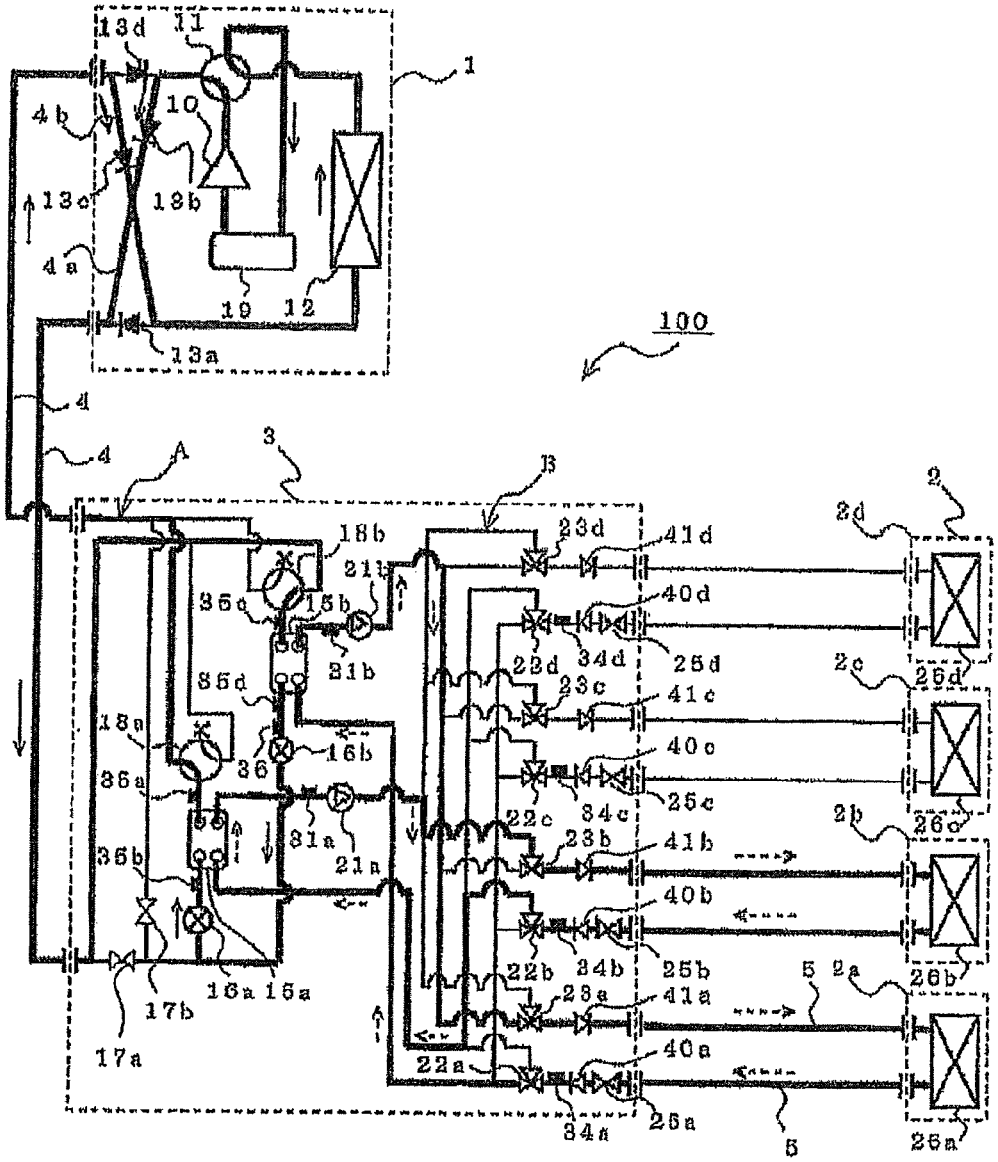
FIG. 6 is a refrigerant circuit diagram illustrating flows of refrigerants in a heating main operation mode of the air-conditioning apparatus 100 according to Embodiment 1 of the invention.

FIG. 6 is a refrigerant circuit diagram illustrating flows of the refrigerants in the heating main operation mode of the air-conditioning apparatus 100 according to Embodiment 1 of the invention. The heating main operation mode will be described with respect to a case in which a heating load is generated in the use side heat exchanger 26*a* and a cooling load is generated in the use side heat exchanger 26*b* in FIG. 6. Note that, in FIG. 6, pipes indicated by thick lines correspond to pipes through which the refrigerant flows and pipes through which the heat medium flows. The direction of flow of the refrigerant is indicated by solid-line arrows and the direction of flow of the heat medium is indicated by broken-line arrows.

In the heating main operation mode illustrated in FIG. 6, the controller switches the refrigerant passage with the first refrigerant flow switching device 11 such that the gas refrigerant discharged from the compressor 10 flows into the heat medium relay unit 3 without passing through the heat source side heat exchanger 12 in the outdoor unit 1. Further, the controller performs an opening and closing control such that the throttle device 16*a* is fully opened, the on-off device 17*a* is in a closed state, and the on-off device 17*b* is in a closed state. Furthermore, in the heat medium relay unit 3, the controller drives the pump 21*a* and the pump 21*b*, opens the heat medium flow control device 25*a* and the heat medium flow control device 25*b*, and totally closes the heat medium flow control device 25*c* and the heat medium flow control device 25*d* such that the heat medium circulates between the heat exchanger related to heat medium 15*a* and the use side heat exchanger 26*a*, and between the heat exchanger related to heat medium 15*b* and the use side heat exchanger 26*b*.

First, the flow of the refrigerant in the refrigerant circuit A will be described with reference to FIG. 6. A low-temperature low-pressure gas refrigerant is compressed by the compressor 10 and is discharged as a high-temperature high-pressure gas refrigerant. The high-temperature high-pressure gas refrigerant that has been discharged from the compressor 10 passes through the check valve 13*b* in the first connecting pipe 4*a* via the first refrigerant flow switching device 11 and flows out of the outdoor unit 1. The high-temperature high-pressure gas refrigerant that has flowed out of the outdoor unit 1 flows into the heat medium relay unit 3 via the refrigerant pipe 4.

The high-temperature high-pressure gas refrigerant that has flowed into the heat medium relay unit 3 passes through the second refrigerant flow switching device 18*b* and flows into the heat exchanger related to heat medium 15*b* functioning as a condenser. The high-temperature high-pressure gas refrigerant that has flowed into the heat exchanger related to heat medium 15*b* is condensed while heating the heat medium circulating in the heat medium circuit B by rejecting heat thereto, and is turned into a liquid refrigerant. The liquid refrigerant flowing out of the heat exchanger related to heat medium 15*b* is expanded and decompressed into a low-temperature low-pressure two-phase gas-liquid refrigerant by the throttle device 16*b*. This low-temperature low-pressure two-phase gas-liquid refrigerant flows through the throttle device 16*a* and into the heat exchanger related to heat medium 15*a* functioning as an evaporator. The low-temperature low-pressure two-phase gas-liquid refrigerant that has flowed into the heat exchanger related to heat medium 15*a* removes heat from the heat medium circulating in the heat medium circuit B and cools the heat medium while being evaporated. The low-temperature low-pressure two-phase gas-liquid refrigerant flowing out of the heat exchanger related to heat medium 15*a* passes through the second refrigerant flow switching device 18*a*, flows out of the heat medium relay unit 3, and flows into the outdoor unit 1 again through the refrigerant pipe 4.

The two-phase gas-liquid refrigerant that has flowed into the outdoor unit 1 passes through the check valve 13*c* in the second connecting pipe 4*b* and flows into the heat source side heat exchanger 12. The two-phase gas-liquid refrigerant that has flowed into the heat source side heat exchanger 12 is gasified while receiving heat from the outdoor air and becomes a low-temperature low-pressure gas refrigerant. The low-temperature low-pressure gas refrigerant flowing out of the heat source side heat exchanger 12 is sucked into the compressor 10 again via the first refrigerant flow switching device 11 and the accumulator 19.

At this time, the controller controls the opening degree of the throttle device 16*b* such that the subcooling obtained as the difference between a value of the saturation temperature converted from the pressure detected by the pressure sensor 36 and a temperature detected by the third temperature sensor 35*b* is constant.

Alternatively, the throttle device 16*b* may be fully opened and the throttle device 16*a* may control the subcooling described above.

Next, the flow of the heat medium in the heat medium circuit B will be described with reference to FIG. 6. In the heating main operation mode, heating energy of the refrigerant is transferred to the heat medium in the heat exchanger related to heat medium 15*b*, and the heated heat medium is made to circulate in the heat medium circuit B by the pump 21*b*. Further, in the heating main operation mode, cooling energy of the refrigerant is transferred to the heat medium in the heat exchanger related to heat medium 15*a*, and the cooled heat medium is made to circulate in the heat medium circuit B by the pump 21*a*.

The heat medium, which has flowed out of the pump 21*b* while being pressurized, flows out of the heat medium relay unit 3 through the second heat medium flow switching device 23*a* and the second backflow prevention device 41*a*, and flows into the indoor unit 2*a* through the heat medium pipe 5. The heat medium, which has flowed out of the pump 21*a* while being pressurized, flows out of the heat medium relay unit 3 through the second heat medium flow switching device 23*b* and the second backflow prevention device 41*b*, and flows into the indoor unit 2*b* through the heat medium pipe 5. Here, since the heat medium flow control device 25*c* and the heat medium flow control device 25*d* are in a totally closed state, the heat medium does not flow into the indoor unit 2*c* through the second heat medium flow switching device 23*c* and the second backflow prevention device 41*c*, and into the indoor unit 2*d* through the second heat medium flow switching device 23*d* and the second backflow prevention device 41*d*.

The heat medium that has flowed into the indoor unit 2*b* flows into the use side heat exchanger 26*b*, and the heat medium that has flowed into the indoor unit 2*a* flows into the use side heat exchanger 26*a*. The heat medium that has flowed into the use side heat exchanger 26*b* removes heat from the indoor air; hence, cooling of the indoor space 7 is carried out. Meanwhile, the heat medium that has flowed into the use side heat exchanger 26*a* rejects heat to the indoor air; hence, heating of the indoor space 7 is carried out. Further, the heat medium that has flowed out of the use side heat exchanger 26*b* with an increase in temperature to a certain degree flows out of the indoor unit 2*b*, and flows into the heat medium relay unit 3 through the heat medium pipe 5. Meanwhile, the heat medium that has flowed out of the use side heat exchanger 26*a* with a decrease in temperature to a certain degree flows out of the indoor unit 2*a*, and flows into the heat medium relay unit 3 through the heat medium pipe 5.

The heat medium that has flowed into the heat medium relay unit 3 from the use side heat exchanger 26*b* flows into the heat medium flow control device 25*b*, and the heat medium that has flowed into the heat medium relay unit 3 form the use side heat exchanger 26*a* flows into the heat medium flow control device 25*a*. At this time, with the function of the heat medium flow control device 25*a* and the heat medium flow control device 25*b*, the heat medium flowing into each of the use side heat exchanger 26*a* and the use side heat exchanger 26*b* is controlled to a flow rate that is sufficient to cover an air conditioning load required indoors. The heat medium that has flowed out of the heat medium flow control device 25*b* passes through the first backflow prevention device 40*b* and the first heat medium flow switching device 22*b*, flows into the heat exchanger related to heat medium 15*a*, and is sucked into the pump 21*a* again. Meanwhile, the heat medium that has flowed out of the heat medium flow control device 25*a* passes through the first backflow prevention device 40*a* and the first heat medium flow switching device 22*a*, flows into the heat exchanger related to heat medium 15*b*, and is sucked into the pump 21*b* again. As described above, in the heating main operation mode, with the function of the first heat medium flow switching devices 22 and the second heat medium flow switching devices 23, the heated heat medium and the cooled heat medium are distributed to the respective use side heat exchangers 26 having a heating load and a cooling load, without being mixed.

Further, the air conditioning load required in the indoor space 7 is covered by controlling the temperature difference between the temperature detected by the first temperature sensor 31*b* and that detected by the second temperature sensor 34*a* so as to be at a target value for the heating side, and is covered by controlling the temperature difference between the temperature detected by the second temperature sensor 34*b* and that detected by the first temperature sensor 31*a* so as to be at a target value for the cooling side.

Upon implementing the heating main operation mode described above, since it is unnecessary to supply the heat medium to each use side heat exchanger 26 having no heat load (including thermo-off), the heat medium is not allowed to flow into the corresponding use side heat exchanger 26 by closing the passage with the corresponding heat medium flow control device 25. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

(Structure and Arrangement of First Heat Medium Flow Switching Devices 22, Second Heat Medium Flow Switching Devices 23, and Heat Medium Flow Control Devices 25 of Heat Medium Relay Unit 3)

FIG. 7 includes drawings showing a structure and arrangement of the first heat medium flow switching devices 22, the second heat medium flow switching devices 23, and the heat medium flow control devices 25 of the heat medium relay unit 3 of the air-conditioning apparatus 100 according to Embodiment 1 of the invention. FIG. 7(*a*) is a drawing of the heat medium relay unit 3 viewed from its top side illustrating a state in which each of the first heat medium flow switching devices 22 and the second heat medium flow switching devices 23 are connected to a corresponding heat medium pipe and are disposed in the heat medium relay unit 3. Further, FIG. 7(*b*) is a drawing of the heat medium relay unit 3 viewed from one lateral side 3*a* (hereinafter, referred to as a "service side") of the housing 3*x* of the heat medium relay unit 3 illustrating a state in which each of the first heat medium flow switching devices 22 and the corresponding one of the heat medium flow control devices 25 are connected with a heat medium pipe.

Note that while the heat medium relay unit 3 illustrated in FIG. 2 to FIG. 6 is a four-branch structure including four of each of the first heat medium flow switching devices 22 and the second heat medium flow switching devices 23, the structure and arrangement illustrated in FIG. 7 is a five-branch structure including five of each of the first heat medium flow switching devices 22, the second heat medium flow switching devices 23, and the heat medium flow control devices 25. However, in Embodiment 1, the number of branches is not limited thereto, and the effect of the air-conditioning apparatus 100 does not differ with the number of branches.

As shown in FIG. 7(*a*), each first heat medium flow switching device 22 and each second heat medium flow switching device 23 is disposed such that a drive motor for flow switching is on the top side. Further, while the second heat medium flow switching devices 23 are arranged in a straight line between a plurality of heat medium pipes arranged in parallel, the first heat medium flow switching devices 22 are arranged in a zigzag manner between a plurality of heat medium pipes arranged in parallel.

Further, as shown in FIG. 7(*b*), a heat medium flow control device 25 is disposed below each first heat medium flow switching device 22. The heat medium flow control devices 25 are similarly disposed in a zigzag manner in accordance with the zigzag arrangement of the first heat medium flow switching devices 22. Furthermore, each heat medium flow control device 25 is disposed such that a drive motor for flow control of the heat medium is on the lateral side, that is, on the service side. In addition, the heat medium relay unit 3 is structured such that servicing, such as maintenance, is allowed from its lateral side, and the heat medium flow control devices 25 are disposed such that they are somewhat toward the lateral side, which allows servicing to be conducted, enabling replacement thereof at times of failure or the like.

Note that while it has been described that each heat medium flow control device 25 is disposed below the corresponding first heat medium flow switching device 22, the disposition is not limited to this, and each heat medium flow control device 25 may be disposed above the corresponding first heat medium flow switching device 22.

Figure 8:
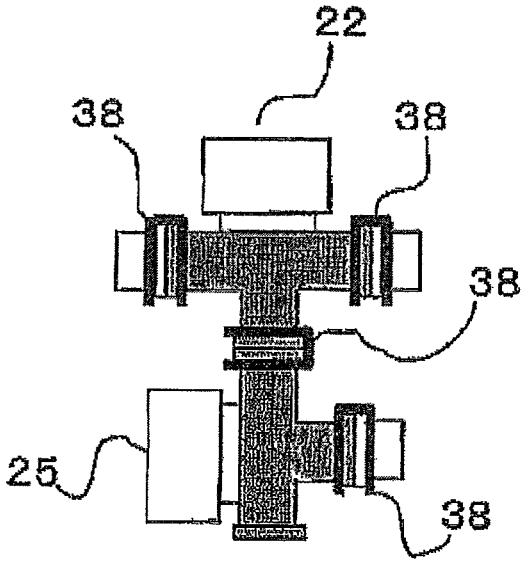
FIG. 8 is a drawing showing a connection structure of the first heat medium flow switching device 22 and the heat medium flow control device 25 of the heat medium relay unit 3 of the air-conditioning apparatus 100 according to Embodiment 1 of the invention.
Figure 9:
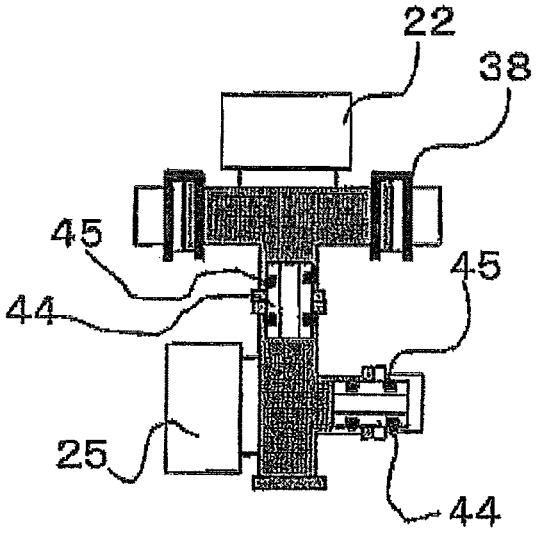
FIG. 9 is a cutaway sectional diagram showing a connecting portion of the first heat medium flow switching device 22 and the heat medium flow control device 25 of the heat medium relay unit 3 of the air-conditioning apparatus 100 according to Embodiment 1 of the invention.

FIG. 8 is a drawing showing a connection structure of the first heat medium flow switching device 22 and the heat medium flow control device 25 of the heat medium relay unit 3 of the air-conditioning apparatus 100 according to Embodiment 1 of the invention, and FIG. 9 is a cutaway sectional diagram showing a connecting portion of the first heat medium flow switching device 22 and the heat medium flow control device 25 of the heat medium relay unit 3. Further, FIG. 8 and FIG. 9 are drawings viewed from the C direction of FIG. 7(*b*).

As illustrated by FIG. 8 and FIG. 9, the first heat medium flow switching device 22 and the heat medium flow control device 25 are connected directly to each other. Here, as shown in FIG. 2 to FIG. 6, each first backflow prevention device 40 arranged between the corresponding first heat medium flow switching device 22 and heat medium flow control device 25 is built into the connecting pipe on the corresponding first heat medium flow switching device 22 side or into the connecting pipe of the corresponding heat medium flow control device 25.

Note that, as described above, the first backflow prevention device 40 may be disposed as a different housing from that of the first heat medium flow switching device 22 and heat medium flow control device 25.

Further, as shown in FIG. 9, each of the connection of the first heat medium flow switching device 22 to the heat medium flow control device 25 and the connection of the heat medium flow control device 25 to the first heat medium flow switching device 22 is formed as a joint 44, whose internal portion is disposed with an O-ring 45. The joint 44 of the first heat medium flow switching device 22 and the joint 44 of the heat medium flow control device 25 abut against each other, are fixed with a fastener 38, and, thus, are connected (connected by a quick fastener). Here, by disposing the O-ring 45 inside both joints, the joints are sealed such that no heat medium leaks from the connecting portion of the joints. Further, since the first heat medium flow switching device 22 and the heat medium flow control device 25 have a sealing structure as above, they have a connection structure that allows easy dismantling without requiring any tools.

Furthermore, the other connection (on the heat medium pipe 5 side) of the heat medium flow control device 25 is positioned on the opposite side of the drive motor disposed on the lateral side and is connected to the heat medium pipe, which is to be connected, with a similar structure as described above.

In addition, since the heat medium relay unit 3 according to Embodiment 1 is disposed above a ceiling, in the back of a wall, or the like, size reduction thereof is demanded. As such, as shown in FIG. 8, the first heat medium flow switching device 22, the second heat medium flow switching device 23, and the heat medium flow control device 25 are disposed such that the installation gaps therebetween are small. When disposed in the above state in which the installation gaps are small, for example, when the first heat medium flow switching devices 22 are disposed in a straight line and the heat medium flow control devices 25 that are subject to maintenance are similarly disposed in a straight line, a serviceperson cannot insert his/her hand into the gap between the heat medium flow control devices 25, and, as such, replacement work of the heat medium flow control device 25 becomes difficult. However, as described above in Embodiment 1, since the first heat medium flow switching devices 22 are arranged in a zigzag manner and the heat medium flow control devices 25 are accordingly arranged in a zigzag manner, the serviceperson can insert his/her hand into the gap between the heat medium flow control devices 25 and replace the failed heat medium flow control device 25. As such, serviceability can be improved while allowing the heat medium relay unit 3 to be kept small.

(Replacing Method of Heat Medium Flow Control Device 25)

Figure 10:
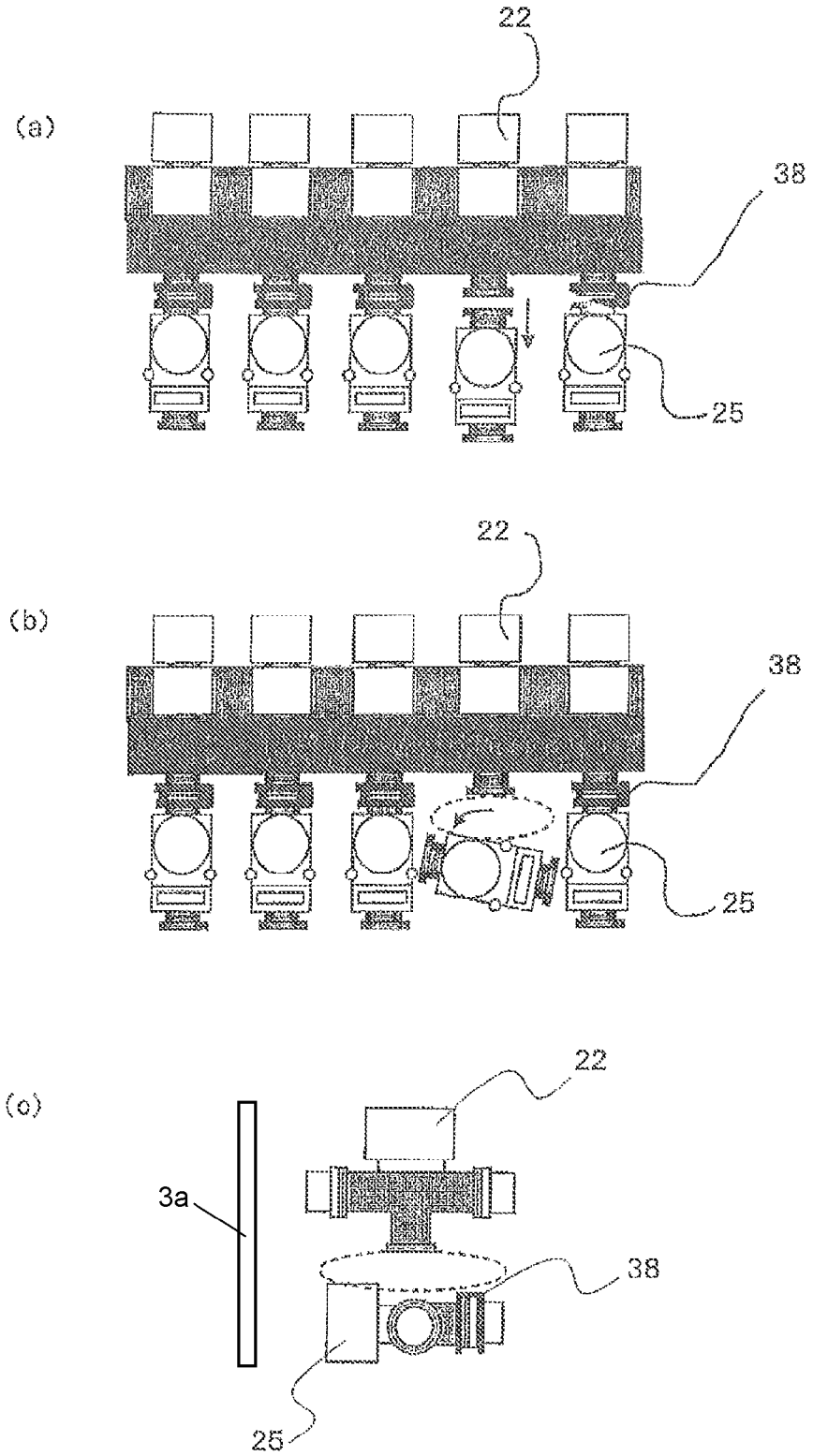
FIG. 10 is a diagram illustrating a replacement procedure of a heat medium flow control device 25 of the heat medium relay unit 3 according to Embodiment 1 of the invention.

FIG. 10 is a diagram illustrating a replacement procedure of the heat medium flow control device 25 of the heat medium relay unit 3 according to Embodiment 1 of the invention. A replacing method of the heat medium flow control device 25 will be described below with reference to FIG. 10.

First, as illustrated in FIG. 10(*a*), the serviceperson removes the fastener 38 that is connecting the first heat medium flow switching device 22 and the heat medium flow control device 25, and moves the heat medium flow control device 25 in the arrow direction.

Next, as illustrated in FIG. 10(*b*), the serviceperson turns the heat medium flow control device 25 in the arrow direction and inserts his/her hand into the area surrounded by the broken line.

Note that the turning direction of the heat medium flow control device 25 may be opposite.

Finally, as illustrated in FIG. 10(*c*), the serviceperson removes the fastener 38 that is connecting the other connection (on the heat medium pipe 5 side) of the heat medium flow control device 25 and the heat medium pipe, pulls the heat medium flow control device 25 to the front, and takes the heat medium flow control device out of the heat medium relay unit 3.

With the above procedure, the serviceperson can easily remove the heat medium flow control device 25 without using any special tools or the like. Further, when newly installing the replacement heat medium flow control device 25, installation can be facilitated by performing a procedure opposite to the procedure above.

Furthermore, as described above, since a plurality of heat medium flow control devices 25 are arranged in a zigzag manner, when the serviceperson turns the heat medium flow control device 25 as illustrated in FIG. 10(*b*), the heat medium flow control device 25 can be turned and removed without interfering with the neighboring heat medium flow control devices 25.

Figure 11:
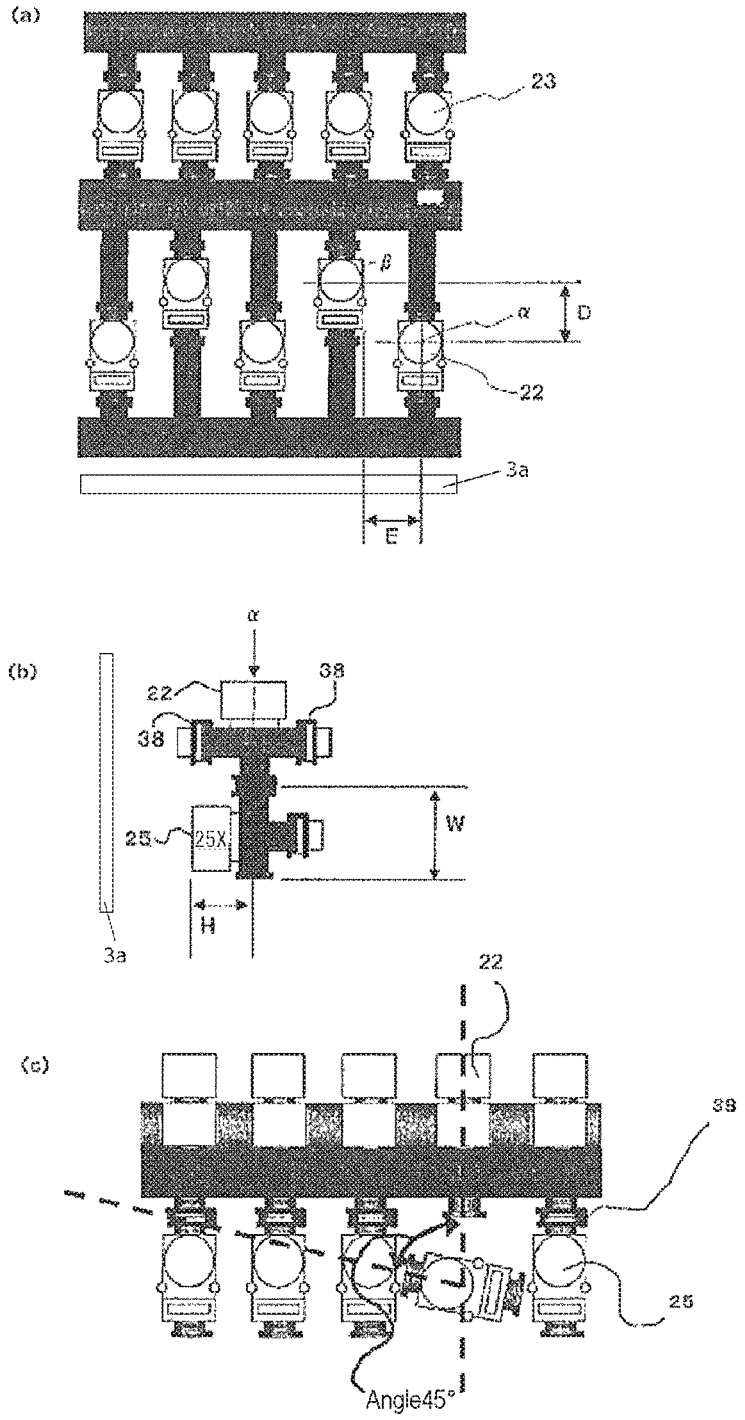
FIG. 11 is a diagram illustrating the installation pitch of the heat medium flow control devices 25 of the heat medium relay unit 3 according to Embodiment 1 of the invention.

FIG. 11 is a diagram illustrating installation pitch of the heat medium flow control devices 25 of the heat medium relay unit 3 according to Embodiment 1 of the invention.

As illustrated in FIG. 11(*a*), the installation pitch refers to a distance component, in a direction orthogonal to the passage direction of the first heat medium flow switching device 22, between the side edge surface β of the drive motor 25X of the heat medium flow control device 25 and the center a of the passage of the neighboring heat medium flow control device 25. This installation pitch is designated as "pitch E". Further, as illustrated in FIG. 11(*b*), the dimension in the height direction of the disposed heat medium flow control device 25 is designated as "height W" and the height of the drive motor 25X from the center of the passage of the heat medium flow control device 25 (the distance to the edge surface of the drive motor 25X) is designated as "height H". Here, it is assumed that during the replacement procedure of the heat medium flow control device 25, when the heat medium flow control device 25 is turned as illustrated in FIG. 10(*b*) described above, turning is performed with the middle point of the height W as its center.

As illustrated in FIG. 10(*b*) described above, when the serviceperson turns the heat medium flow control device 25 and inserts his/her hand into the area surrounded by the broken line, if the turning angle θ of the heat medium flow control device 25 used to remove the fastener 38 that is connecting the other connection (on the heat medium pipe 5 side) of the heat medium flow control device 25 and the heat medium pipe, as illustrated in FIG. 10(*c*), is 45° or more, as illustrated in FIG. 11(*c*), the removal of the heat medium flow control device 25 can be carried out easily. As such, when the pitch E satisfies the following Expression (1), it will be possible to remove the heat medium flow control device with ease.

$$E>(W/2)\cdot\sin(45°) \quad (1)$$

Next, an interval D between the first heat medium flow switching devices 22 that are arranged in a zigzag manner, as illustrated in FIG. 11(*a*), will be described. The interval D is a distance component between the center a of the passage of the heat medium flow control device 25 and the center a of the passage of the neighboring heat medium flow control device 25 in the passage direction of the first heat medium flow switching device 22. As described above, in order to turn the heat medium flow control device 25, the heat medium flow control device 25 should not interfere with the drive motor 25X of the neighboring heat medium flow control device 25. At this time, when an interval D that is larger than the motor height H is obtained, that is, if a condition D>H is satisfied, then it will be possible to turn the heat medium flow control device 25 45° or more without any interference with the drive motor 25X of the neighboring heat medium flow control device 25. Accordingly, as above, as regards the interval D, by satisfying the condition D>H, it will be possible to remove the heat medium flow control device 25 easily. Further, regarding the interval D, by satisfying the condition D>H, it will be possible to turn the heat medium flow control device 25 45° or more without any interference with the drive motor 25X of the neighboring heat medium flow control device 25 even when Expression (1) is not necessarily satisfied. On the other hand, regarding the pitch E, by satisfying the Expression (1) described above, even when the condition D>H is not satisfied, it will be possible to turn the heat medium flow control device 25 45° or more without any interference with the drive motor 25X of the neighboring heat medium flow control device 25.

Advantageous Effects of Embodiment 1

With the configuration described above, the heat medium, such as water, brine, or the like, is circulated in the indoor units 2 and no refrigerant is circulated therein; hence, an air-conditioning apparatus 100 having improved safety in which refrigerant does not leak into the indoor space 7 or the like can be obtained.

However, as described in FIG. 7(*a*), by arranging the first heat medium flow switching devices 22 and the heat medium flow control devices 25 in a zigzag manner, the serviceperson can insert his/her hand into the gap between the heat medium flow control devices 25 and replace the failed heat medium flow control device 25. As such, serviceability can be improved while allowing the heat medium relay unit 3 to be kept small.

Further, since the serviceperson can turn the heat medium flow control device 25 45° or more when removing the heat medium flow control device 25, it is possible to insert his/her hand and easily remove the fastener 38 that is connecting the other connection (on the heat medium pipe 5 side) of the heat medium flow control device 25 and the heat medium pipe, and, thus, serviceability can be improved.

Note that although the arrangement of each of the first heat medium flow switching devices 22 and the heat medium flow control devices 25 of the heat medium relay unit 3 according to Embodiment 1 is a zigzag manner as illustrated in FIG. 7(*a*), the invention is not limited to this arrangement and the first heat medium flow switching devices 22 may be arranged alternately with each other with a positional relation in which the centers a of neighboring first heat medium flow switching devices 22 do agree with each other in a direction orthogonal to the direction of the heat medium pipe of the first heat medium flow switching devices 22. In this case, if the relation between the neighboring first heat medium flow switching devices 22 and the heat medium flow control devices 25 satisfies Equation (1) described above or satisfies the condition D>H, then it will be possible to turn the heat medium flow control device 25 45° or more, and facilitation of removing the heat medium flow control device 25 can be obtained.

The invention claimed is:

1. A heat medium relay unit comprising:

a heat exchanger of an conditioning system related to heat medium that exchanges heat between a refrigerant in a refrigerant circuit in which the refrigerant is circulated by being discharged from a compressor provided in an outdoor unit and a heat medium, which is different from the refrigerant, in a heat medium circuit in which the heat medium is circulated and sent to a plurality of indoor units with a pump;

a plurality of heat medium flow control devices of the air conditioning system that each control a flow rate of the heat medium sent to a use side heat exchanger of the corresponding indoor unit; and a plurality of heat medium flow switching devices of the air conditioning system disposed so as to correspond to the respective indoor units, the heat medium flow switching devices communicating an inlet side passage or an outlet side passage of the heat medium of each use side heat exchanger with the heat exchanger related to heat medium, the heat medium relay unit having the plurality of heat medium flow control devices and the plurality of heat medium flow switching devices in a different housing from the outdoor unit and the indoor units, wherein a pipe port of each of the heat medium flow control devices is connected to a pipe port of a corresponding one of the heat medium switching devices, the plurality of heat medium flow control devices are provided on one side of the housing, the plurality of heat medium flow switching devices are arranged substantially orthogonal to the one side of the housing, and each of the plurality of heat medium flow control devices has a drive motor for controlling the flow rate of the heat medium, and the drive motor is installed on the side of the housing.

2. The heat medium relay unit of claim 1, wherein the heat medium flow switching devices are arranged in the heat medium pipes in a zigzag manner.

3. The heat medium relay unit of claim 1, wherein the heat medium flow switching devices and the heat medium flow control devices are disposed such that a vertical interval, in a passage direction of the heat medium flow switching device, between a center of a passage of a heat medium flow control device in a direction substantially orthogonal to a passage direction of a heat medium flow switching device and a center of a passage of a neighboring heat medium flow control device in a direction substantially orthogonal to a passage direction of a heat medium flow switching device, is larger than a height from the center to an edge portion of the drive motor.

4. The heat medium relay unit of claim 1, wherein the heat medium flow control devices are each arranged so as to be capable of being turned 45° or more around a center without interfering with a neighboring heat medium flow control device, the center being another one of pipe ports.

5. The heat medium relay unit of claim 4, wherein the heat medium flow switching devices and the heat medium flow control devices are arranged such that an installation pitch is larger than a product of half a height of the heat medium flow control device in the vertical direction and sin (45°), the installation pitch being, in a direction substantially orthogonal to a passage direction of a heat medium flow switching device, between a side edge surface of the drive motor of a heat medium flow control device and a center of a passage of a neighboring heat medium flow control device in a direction substantially orthogonal to a passage direction of a heat medium flow switching device.

6. The heat medium relay unit of claim 1, wherein a pipe port of each of the heat medium flow switching devices and one of pipe ports of the corresponding heat medium flow control devices, and another one of pipe ports of each of the heat medium flow control devices and the pipe ports of a corresponding heat medium pipe that is oriented toward the corresponding indoor unit are fixed and connected by means of a fastener that is capable of quick fastener connection.

7. An air-conditioning apparatus, comprising:

the heat medium relay unit of claim 1 including an expansion device that expands the refrigerant and the pump that sends out the heat medium;

the outdoor unit including the compressor, the four-way valve, and a heat source side heat exchanger; and the indoor units each including the use side heat exchanger, wherein the refrigerant circuit includes the compressor, the four-way valve, the heat source side heat exchanger, the expansion valve, and the heat exchanger related to heat medium that are connected by refrigerant pipes, and the heat medium circuit includes the pump, the heat medium flow switching devices, the use side heat exchangers, the heat source side flow control devices, and the heat exchanger related to heat medium that are connected by heat medium pipes.

8. The heat medium relay unit of claim 1, wherein a first set of pipe ports of each of the heat medium flow control devices is connected to a pipe port on a top side of a corresponding one of the heat medium flow switching devices or the first set of the pipe ports of each of the heat medium flow control devices is connected to a pipe port on a bottom side of the corresponding of the heat medium flow switching devices.

9. The heat medium relay unit of claim 1, wherein a second set of pipe ports of each of the heat medium flow control devices is piped to a heat medium pipe that is positioned opposite to the one side of the housing and that is oriented towards a corresponding one of the indoor units in the direction that is substantially orthogonal to the one side of the housing.

10. The heat medium relay unit of claim 1, wherein the plurality of heat medium flow switching devices are arranged such that neighboring two of the heat medium flow switching devices are offset from each other in at least one plane.

11. The heat medium relay unit of claim 1, wherein the drive motor has a height, the plurality of heat medium flow switching devices are arranged at equally spaced first intervals along a first direction, each of the equally space first intervals having a first width greater than the height of the drive motor, and the plurality of heat medium flow switching device are arranged at equally spaced second intervals along a second direction that is perpendicular to the first intervals, each of the equally spaced second intervals having a second width greater than the height of the drive motor.

* * * * *